US008704619B2

(12) United States Patent
Ninomiya et al.

(10) Patent No.: US 8,704,619 B2
(45) **Date of Patent: *Apr. 22, 2014**

(54) BANDPASS FILTER AND RADIO COMMUNICATION MODULE AND RADIO COMMUNICATION DEVICE USING THE SAME

(75) Inventors: Hiroshi Ninomiya, Kirishima (JP); Hiromichi Yoshikawa, Kirishima (JP)

(73) Assignee: Kyocera Corporation, Kyoto (JP)

( * ) Notice: Subject to any disclaimer, the term of this patent is extended or adjusted under 35 U.S.C. 154(b) by 688 days.

This patent is subject to a terminal disclaimer.

(21) Appl. No.: 12/995,172

(22) PCT Filed: May 28, 2009

(86) PCT No.: PCT/JP2009/059815

§ 371 (c)(1), (2), (4) Date: Nov. 29, 2010

(87) PCT Pub. No.: WO2009/145277

PCT Pub. Date: Dec. 3, 2009

(65) Prior Publication Data

US 2011/0080235 A1 Apr. 7, 2011

(30) Foreign Application Priority Data

May 28, 2008 (JP) ..... 2008-139327
Jun. 26, 2008 (JP) ..... 2008-167417

(51) Int. Cl.
*H01P 1/203* (2006.01)
*H01P 7/08* (2006.01)

(52) U.S. Cl.
USPC ..... 333/204; 333/219

(58) Field of Classification Search
USPC ..... 333/204, 205, 219, 235
See application file for complete search history.

(56) References Cited

U.S. PATENT DOCUMENTS 5,926,466 A 7/1999 Ishida et al.
6,147,571 A 11/2000 Kitazawa et al.
(Continued)

FOREIGN PATENT DOCUMENTS

JP 61-258503 A 11/1986
JP 1990-64203 A 11/1991
(Continued)

OTHER PUBLICATIONS

Li, K., et al., "An Ultra-Wideband Bandpass Filter Using Broadside-Coupled Microstrip-Coplanar Waveguide Structure," Proceedings of the Mar. 2005 IEICE General Conference, C-2-114, p. 147.

*Primary Examiner* — Benny Lee
*Assistant Examiner* — Gerald Stevens
(74) *Attorney, Agent, or Firm* — Birch, Stewart, Kolasch & Birch, LLP

(57) ABSTRACT

Provided are a bandpass filter and a radio communication module and a radio communication device using the same. The bandpass filter includes: a first and a second grounding electrode arranged on the upper and the lower surface of a layered body; first resonance electrodes and second resonance electrodes arranged to orthogonally intersect the first resonance electrodes; a first input coupling electrode opposing to the first resonance electrode of the input stage and a second input coupling electrode connected thereto and opposing to the second resonance electrode of the input stage; a first output coupling electrode opposing to the first resonance electrode of the output stage and a second output coupling electrode connected thereto and opposing to the second resonance electrode of the output stage.

12 Claims, 21 Drawing Sheets

(56) References Cited

U.S. PATENT DOCUMENTS

| | | | |
|---|---|---|---|
| 6,177,853 | B1 | 1/2001 | Nagatomi et al. |
| 6,359,531 | B1 | 3/2002 | Nagatomi et al. |
| 7,679,475 | B2 | 3/2010 | Yoshikawa |
| 2009/0140827 | A1 | 6/2009 | Yoshikawa |
| 2010/0219915 | A1 | 9/2010 | Yoshikawa et al. |

FOREIGN PATENT DOCUMENTS

| | | | |
|---|---|---|---|
| JP | 2000-516060 | T | 11/2000 |
| JP | 2004-180032 | A | 6/2004 |
| JP | 2008-118615 | A | 5/2008 |
| JP | 2009-088596 | A | 4/2009 |
| JP | 2008-321738 | A | 7/2010 |
| JP | 2010-209706 | A | 9/2010 |
| WO | WO-2009/028691 | A1 | 3/2009 |

BANDPASS FILTER AND RADIO COMMUNICATION MODULE AND RADIO COMMUNICATION DEVICE USING THE SAME

This application is the national stage of International Application No. PCT/JP2009/059815 filed on May 28, 2009, which claims priority under 35 USC §119 (a)-(d) of Application No. 2008-139327 filed in Japan on May 28, 2008 and Application No. 2008-167417 filed in Japan on Jun. 26, 2008.

FIELD

The present invention relates to a bandpass filter and a radio communication module and a radio communication device using the same, particularly to a bandpass filter comprising a remarkably wide passband that can suitably be used for UWB (Ultra Wide Band) and a radio communication module and a radio communication device using the same.

BACKGROUND

Recently UWB receives attention as new communication means. In UWB, large-capacity data transfer can be realized within a short range of about 10 m by the use of a wide frequency band.

Recently a study on an ultra-wide-band filter that can be used for UWB is actively made. For example, there has been reported that a wide-band characteristic of a passband width exceeding 100% in terms of fractional band width (band width/center frequency) is obtained with a bandpass filter in which a principle of a directional coupler is applied (for example, see Non-patent Document 1);

On the other hand, a bandpass filter in which a plurality of quarter-wave stripline resonators are provided in parallel while mutually coupled is well known as a filter frequently used conventionally (for example, see Japanese Patent Publication Laid-Open No. 2004-180032).

PRIOR ART REFERENCE

Patent Reference

Patent reference 1: JP2004-180032

Non-Patent Reference

Non-patent reference 1: "Ultra-Wide-Band Bandpass Filter with Micro Strip-cpw Broadside Coupling Structure", IEICE Proceedings (March, 2005) c-2-114, P. 147).

SUMMARY OF INVENTION

Problems to be Solved by the Invention

However, the bandpass filters proposed in Non-patent Document 1 and Patent Document 1 had problems respectively, and in particular, were not appropriate for the UWB bandpass filter.

For example, the bandpass filter proposed in Non-patent Document 1 had a problem in that the passband width was too wide. In other words, the UWB basically uses a frequency band ranging from 3.1 GHz to 10.6 GHz, whereas the Radiocommunications Sector of the International Telecommunication Union proposes a standard that demultiplexes into Low Band using a frequency band ranging from approximately 3.1 to 4.7 GHz, and High Band using a frequency band ranging from approximately 6 GHz to 10.6 GHz, thus avoiding the use of 5.3 GHz at IEEE802.11.a. Accordingly, because both a passband width ranging from approximately 40% to 50% of the fractional bandwidth and attenuation at 5.3 GHz are required simultaneously for filters used for Low Band and High Band of UWB, the bandpass filter proposed in Non-patent document 1 comprising a characteristic with a passband width greater than 100% of the fractional bandwidth could not be used due to its wide passband width.

Additionally, the passband width of the bandpass filter using a conventional ¼ wavelength resonator is too narrow, and even the passband width of the bandpass filter described in Patent document 1, which attempted to provide a wider bandwidth, did not meet 10% of the fractional bandwidth. Accordingly, it cannot be used as a bandpass filter for UWB, which requires a wide passband width corresponding to 40% to 50% of the fractional bandwidth.

The present invention has been devised in view of the problems in the prior art, with the objective of providing a bandpass filter, which has two substantially wide passbands and which can obtain an excellent filter characteristics even if it is thinned, as well as a wireless communication module and a wireless communication device using the same.

Means for Solving the Problem

The bandpass filter of the first embodiment of the present invention comprises a laminated body, a first ground electrode, a second ground electrode, a plurality of strip-shaped first resonance electrodes, a plurality of strip-shaped second resonance electrodes, a strip-shaped first input coupling electrode, a strip-shaped first output coupling electrode, a second input coupling electrode, and a second output coupling electrode. The laminated body comprises a plurality of laminated dielectric layers. The first ground electrode is disposed on the bottom surface of the laminated body. The second ground electrode is disposed on the top surface of the laminated body. The plurality of first resonance electrodes are disposed side by side on a first interlayer of the laminated body so as to be electromagnetically coupled to each other, and so that each one end thereof is grounded, functioning as a resonator that resonates at a first frequency. The plurality of second resonance electrodes are disposed side by side on a second interlayer different from the first interlayer of the laminated body so as to be electromagnetically coupled to each other, and so that each one end thereof is grounded, functioning as a resonator that resonates at a second frequency which is higher than the first frequency.

The first input coupling electrode is disposed on a third interlayer located between the first interlayer and the second interlayer of the laminated body, facing a region over more than half the length, in the longitudinal direction, of the first resonance electrode on the input stage of the plurality of first resonance electrodes and electromagnetically coupled to the region, and has an electrical signal input point into which electrical signals are input. The first output coupling electrode is disposed on the third interlayer of the laminated body, facing a region over more than half the length, in the longitudinal direction, of the first resonance electrode on the output stage of the plurality of first resonance electrodes and electromagnetically coupled to the region, and has an electrical signal output point from which electrical signals are output.

The second input coupling electrode is disposed on an interlayer located between the first interlayer and the second interlayer of the laminated body and facing the second resonance electrode on the input stage of the plurality of second resonance electrodes and electromagnetically coupled to the region. The second output coupling electrode is disposed on the interlayer located between the first interlayer and the second interlayer of the laminated body and facing the second resonance electrode on the output stage of the plurality of second resonance electrodes and electromagnetically coupled to the region.

The plurality of first resonance electrodes and the plurality of second resonance electrodes are disposed orthogonally to each other if seen from the direction of lamination of the laminated body. The second input coupling electrode is connected to the side farther from the electrical signal input point than the center, in the longitudinal direction, of the portion facing the first resonance electrode on the input stage of the first input coupling electrode so that electrical signals are input via the first input coupling electrode. The second output coupling electrode is connected to the side farther from the electrical signal output point than the center, in the longitudinal direction, of the portion facing the first resonance electrode on the output stage of the first output coupling electrode so that electrical signals are output via the first output coupling electrode.

The bandpass filter of the second embodiment of the present invention comprises a laminated body, a first ground electrode, a second ground electrode, four or more strip-shaped first resonance electrodes, a plurality of strip-shaped second resonance electrodes, a strip-shaped first input coupling electrode, a strip-shaped first output coupling electrode, a second input coupling electrode, a second output coupling electrode, and a first resonance electrode coupling conductor. The laminated body comprises a plurality of laminated dielectric layers. The first ground electrode is disposed on the bottom surface of the laminated body. The second ground electrode is disposed on the top surface of the laminated body. The four or more first resonance electrodes are disposed side by side so as to alternate one end and the other end on a first interlayer of the laminated body, each one end thereof is grounded, functioning as a resonator that resonates at a first frequency, and are electromagnetically coupled to each other. The plurality of second resonance electrodes are disposed side by side on a second interlayer different from the first interlayer of the laminated body so as to be electromagnetically coupled to each other, and so that each one end thereof is grounded, functioning as a resonator that resonates at a second frequency which is higher than the first frequency.

The first input coupling electrode is disposed on a third interlayer located between the first interlayer and the second interlayer of the laminated body, facing a region over more than half the length, in the longitudinal direction, of the first resonance electrode on the input stage of the four or more first resonance electrodes and electromagnetically coupled to the region, and has an electrical signal input point into which electrical signals are input. The first output coupling electrode is disposed on the third interlayer of the laminated body, facing a region over more than half the length, in the longitudinal direction, of the first resonance electrode on the output stage of the four or more first resonance electrodes and electromagnetically coupled to the region, and has an electrical signal output point from which electrical signals are output.

The second input coupling electrode is disposed on an interlayer located between the first interlayer and the second interlayer of the laminated body and facing the second resonance electrode on the input stage of the plurality of second resonance electrodes and electromagnetically coupled to the second resonance electrode. The second output coupling electrode is disposed on an interlayer located between the first interlayer and the second interlayer of the laminated body, and facing the second resonance electrode on the output stage of the plurality of second resonance electrodes and electromagnetically coupled to the second resonance electrode.

The first resonance electrode coupling conductor is disposed on a fourth interlayer located on the opposite side from the third interlayer sandwiching the first interlayer of the laminated body in between. With regard to the first resonance electrode coupling conductor, one end thereof is grounded in the close vicinity of the one end of the first resonance electrode on the foremost stage constituting a first resonance electrode group comprising an even number of four or more of adjacent first resonance electrodes, the other end thereof is grounded in the close vicinity of the one end of the first resonance electrode on the rearmost stage constituting the first resonance electrode group, and it has regions that are electromagnetically coupled so as to face the first resonance electrode on the foremost stage and the first resonance electrode on the rearmost stage, respectively.

The first resonance electrode and the second resonance electrode are disposed orthogonally to each other if seen from the direction of lamination of the laminated body. The second input coupling electrode is connected to the side farther from the electrical signal input point than the center, in the longitudinal direction, of the portion facing the first resonance electrode on the input stage of the first input coupling electrode so that electrical signals are input via the first input coupling electrode. The second output coupling electrode is connected to the side farther from the electrical signal input point than the center, in the longitudinal direction, of the portion facing the first resonance electrode on the output stage of the first output coupling electrode so that electrical signals are output via the first output coupling electrode.

The bandpass filter of the third embodiment of the present invention comprises a laminated body, a first ground electrode, a second ground electrode, a plurality of strip-shaped first resonance electrodes, four or more strip-shaped second resonance electrodes, a strip-shaped first input coupling electrode, a strip-shaped first output coupling electrode, a second input coupling electrode, a second output coupling electrode, and a second resonance electrode coupling conductor. The laminated body comprises a plurality of laminated dielectric layers. The first ground electrode is disposed on the bottom surface of the laminated body. The second ground electrode is disposed on the top surface of the laminated body.

The plurality of first resonance electrodes are disposed side by side on a first interlayer of the laminated body so as to be electromagnetically coupled to each other, and so that each one end thereof is grounded, functioning as a resonator that resonates at a first frequency. The four or more second resonance electrodes are disposed side by side so as to alternate one end and the other end on a second interlayer different from the first interlayer of the laminated body, each one end thereof is grounded, functioning as a resonator that resonates at a second frequency which is higher than the first frequency, and are electromagnetically coupled to each other.

The first input coupling electrode is disposed on a third interlayer located between the first interlayer and the second interlayer of the laminated body, facing a region over more than half the length, in the longitudinal direction, of the first resonance electrode on an input stage of the plurality of first resonance electrodes and electromagnetically coupled to the region, and has an electrical signal input point into which electrical signals are input. The first output coupling electrode is disposed on the third interlayer of the laminated body, facing a region over more than half the length, in the longitudinal direction, of the first resonance electrode on an output stage of the plurality of first resonance electrodes and electromagnetically coupled to the region, and has an electrical signal output point from which electrical signals are output.

The second input coupling electrode is disposed on an interlayer located between the first interlayer and the second interlayer of the laminated body and facing the second resonance electrode on the input stage of the four or more second resonance electrodes and electromagnetically coupled to the second resonance electrode. The second output coupling electrode is disposed on the interlayer located between the first interlayer and the second interlayer of the laminated body, and facing the second resonance electrode on the output stage of the four or more second resonance electrodes and electromagnetically coupled to the second resonance electrode.

The second resonance electrode coupling conductor is disposed on a fifth interlayer located on the opposite side from the third interlayer sandwiching the second interlayer of the laminated body in between. With regard to the second resonance electrode coupling conductor, one end thereof is grounded in the close vicinity of the one end of the second resonance electrode on the foremost stage constituting a second resonance electrode group comprising an even number of four or more of adjacent second resonance electrodes, the other end thereof is grounded in the close vicinity of the one end of the second resonance electrode on the rearmost stage constituting the second resonance electrode group, and it has regions that are facing the one end of the second resonance electrode on the foremost stage and the second resonance electrode on the rearmost stage, respectively and electromagnetically coupled to the one end.

The first resonance electrode and the second resonance electrode are disposed orthogonally to each other if seen from the direction of lamination of the laminated body. The second input coupling electrode is connected to the side farther from the electrical signal input point than the center, in the longitudinal direction, of the portion facing the first resonance electrode on the input stage of the first input coupling electrode so that electrical signals are input via the first input coupling electrode. The second output coupling electrode is connected to the side farther from the electrical signal output point than the center, in the longitudinal direction, of the portion facing the first resonance electrode on the output stage of the first output coupling electrode so that electrical signals are output via the first output coupling electrode.

The bandpass filter of the fourth embodiment of the present invention comprises a laminated body, a first ground electrode, a second ground electrode, four or more strip-shaped first resonance electrodes, four or more strip-shaped second resonance electrodes, a strip-shaped first input coupling electrode, a strip-shaped first output coupling electrode, a second input coupling electrode, a second output coupling electrode, a first resonance electrode coupling conductor, and a second resonance electrode coupling conductor. The laminated body comprises a plurality of laminated dielectric layers. The first ground electrode is disposed on the bottom surface of the laminated body. The second ground electrode is disposed on the top surface of the laminated body.

The four or more first resonance electrodes are disposed side by side so as to alternate one end and the other end on a first interlayer of the laminated body, each one end thereof is grounded, functioning as a resonator that resonates at a first frequency, and are electromagnetically coupled to each other. The four or more second resonance electrodes are disposed side by side so as to alternate one end and the other end on a second interlayer different from the first interlayer of the laminated body, each one end thereof is grounded, functioning as a resonator that resonates at a second frequency which is higher than the first frequency, and are electromagnetically coupled to each other.

The first input coupling electrode is disposed on a third interlayer located between the first interlayer and the second interlayer of the laminated body, facing a region over more than half the length, in the longitudinal direction, of the first resonance electrode on an input stage of the four or more first resonance electrodes and electromagnetically coupled to the region, and has an electrical signal input point into which electrical signals are input. The first output coupling electrode is disposed on the third interlayer of the laminated body, facing a region over more than half the length, in the longitudinal direction, of the first resonance electrode on the output stage of the four or more first resonance electrodes and electromagnetically coupled to the region, and has an electrical signal output point from which electrical signals are output.

The second input coupling electrode is disposed on an interlayer located between the first interlayer and the second interlayer of the laminated body, and facing the second resonance electrode on the input stage of the four or more second resonance electrodes and electromagnetically coupled to the second resonance electrode. The second output coupling electrode is disposed on an interlayer located between the first interlayer and the second interlayer of the laminated body, and facing the second resonance electrode on the output stage of the four or more second resonance electrodes and electromagnetically coupled to the second resonance electrode.

The first resonance electrode coupling conductor is disposed on a fourth interlayer located on the opposite side from the third interlayer sandwiching the first interlayer of the laminated body in between. With regard to the first resonance electrode coupling conductor, one end thereof is grounded in the close vicinity of the one end of the first resonance electrode on the foremost stage constituting a first resonance electrode group comprising an even number of four or more of adjacent first resonance electrodes, the other end thereof is grounded in the close vicinity of the one end of the first resonance electrode on the rearmost stage constituting the first resonance electrode group, and it has regions that are facing the first resonance electrode on the foremost stage and the first resonance electrode on the rearmost stage, respectively and electromagnetically coupled to the first resonance electrode.

The second resonance electrode coupling conductor is disposed on a fifth interlayer located on the opposite side from the third interlayer sandwiching the second interlayer of the laminated body in between. With regard to the second resonance electrode coupling conductor, one end thereof is grounded in the close vicinity of the one end of the second resonance electrode on the foremost stage constituting a second resonance electrode group comprising an even number of four or more of adjacent second resonance electrodes, the other end thereof is grounded in the close vicinity of the one end of the second resonance electrode on the rearmost stage constituting the second resonance electrode group, and it has regions that are facing the second resonance electrode on the foremost stage and the second resonance electrode on the rearmost stage, respectively and electromagnetically coupled to the second resonance electrode.

The first resonance electrode and the second resonance electrode are disposed orthogonally to each other if seen from the direction of lamination of the laminated body. The second input coupling electrode is connected to the side farther from the electrical signal input point than the center, in the longitudinal direction, of the portion facing the first resonance electrode on the input stage of the first input coupling electrode so that electrical signals are input via the first input coupling electrode. The second output coupling electrode is connected to the side farther from the electrical signal output point than the center, in the longitudinal direction, of the portion facing the first resonance electrode on the output stage of the first output coupling electrode so that electrical signals are output via the first output coupling electrode.

The wireless communication module of the fifth aspect of the present invention comprises the band pass filter according to any of the abovementioned first to fourth embodiments of the present invention.

The wireless communication device of the sixth aspect of the present invention comprises an RF portion including the bandpass filter according to any of the abovementioned first to fourth embodiments of the present invention, a baseband portion connected to the RF portion, and an antenna connected to the RF portion.

However, the electrical signal input point of the first input coupling electrode is a place in which electrical signals are input to the first input coupling electrode, and the electrical signal output point of the first output coupling electrode is a place in which electrical signals are output from the first output coupling electrode. Additionally, regarding what is meant by "the side farther from the electrical signal input point than the center, in the longitudinal direction, of the portion facing the first resonance electrode on the input stage of the first input coupling electrode", it means a region of the side that dose not include the electrical signal input point if the first input coupling electrode is divided into two regions, in the longitudinal direction, at the boundary of the center, in the longitudinal direction, of a portion facing the first resonance electrode on the input stage. Similarly, regarding what is meant by "the side farther from the electrical signal output point than the center, in the longitudinal direction, of the portion facing the first resonance electrode on the output stage of the first output coupling electrode," it means a region of the side that dose not include the electrical signal output point if the first output coupling electrode is divided into two regions, in the longitudinal direction, at the boundary of the center, in the longitudinal direction, of a portion facing the first resonance electrode on the output stage.

Advantageous Effect of the Invention

According to the bandpass filter of the first to the fourth aspects of the present invention, because a first resonance electrode and a second resonance electrode are disposed orthogonally to each other if seen from the direction of lamination of the laminated body, the electromagnetic coupling generated between the first resonance electrode and the second resonance electrode can be minimized even in cases in which the laminated body is thin and the first resonance electrode is in the close vicinity of the second resonance electrode; hence, deterioration of the bandpass characteristics in the passband, resulting from electromagnetic coupling becoming too strong between the first resonance electrode and the second resonance electrode, can be prevented.

Additionally, according to the bandpass filter of the first to the fourth aspects of the present invention, the first input coupling electrode is facing a region over more than half the length, in the longitudinal direction, of the first resonance electrode on the input stage via a dielectric layer and electromagnetically coupled to the region, the first output coupling electrode is facing a region over more than the half the length of the first resonance electrode on the output stage via the dielectric layer and electromagnetically coupled to the region, the second input coupling electrode is connected to the side farther from the electrical signal input point than the center, in the longitudinal direction, of the portion facing the first resonance electrode on the input stage of the first input coupling electrode so that electrical signals are input via the first input coupling electrode, and the second output coupling electrode is connected to the side farther from the electrical signal output point than the center, in the longitudinal direction, of the portion facing the first resonance electrode on the output stage of the first output coupling electrode so that electrical signals are output via the first output coupling electrode. In this way, the electromagnetic coupling of the first coupling electrode with the first resonance electrode on the input stage and the electromagnetic coupling of the first output coupling electrode with the first resonance electrode on the output stage can be sufficiently strengthened; hence, a bandpass filter comprising excellent bandpass characteristics, in which it is flat and low-loss across the entire wide passband formed by a plurality of first resonance electrodes, can be obtained.

According to the wireless communication module of the fifth aspect of the present invention and the wireless communication device of the sixth aspect of the present invention, by using the bandpass filter of the first aspect of the present invention with small signal loss across the entire communication band for filtering waves of sent signals and received signals, attenuation of sent signals and received signals that pass the bandpass filter is reduced, resulting in increased reception sensitivity; in addition, the amplification degree of sent signals and received signals can be small, resulting in less power consumption in the amplifier circuit. Therefore, an enhanced wireless communication module and a wireless communication device with high receiving sensitivity and low power consumption can be obtained. Furthermore, by using the bandpass filter of the first aspect of the present invention, in which two communication bands can be covered by one filter and excellent filter characteristics can be obtained even if it is thinned, a wireless communication module and a wireless communication device with small size and low manufacturing cost can be obtained.

BRIEF DESCRIPTION OF THE DRAWINGS

The objectives, features, and advantages of the present invention shall become apparent from the following detailed description and the figures.

MODE FOR CARRYING OUT THE INVENTION

Hereinafter, a bandpass filter as well as a wireless communication module and a wireless communication device using the same according to the preferred embodiments of the present invention are described in detail with reference to the figures attached.

First Embodiment

Figure 1:
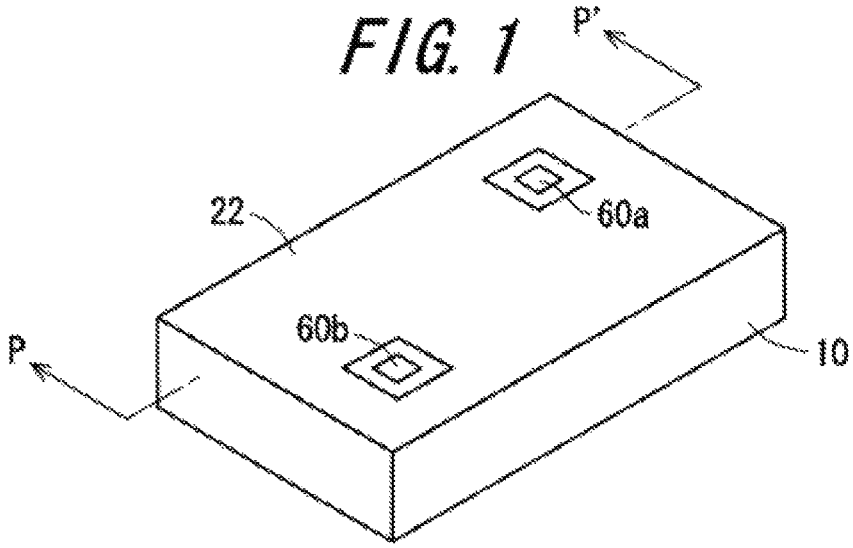
FIG. 1 is an external perspective view schematically showing the bandpass filter according to the first embodiment of the present invention.
Figure 2:
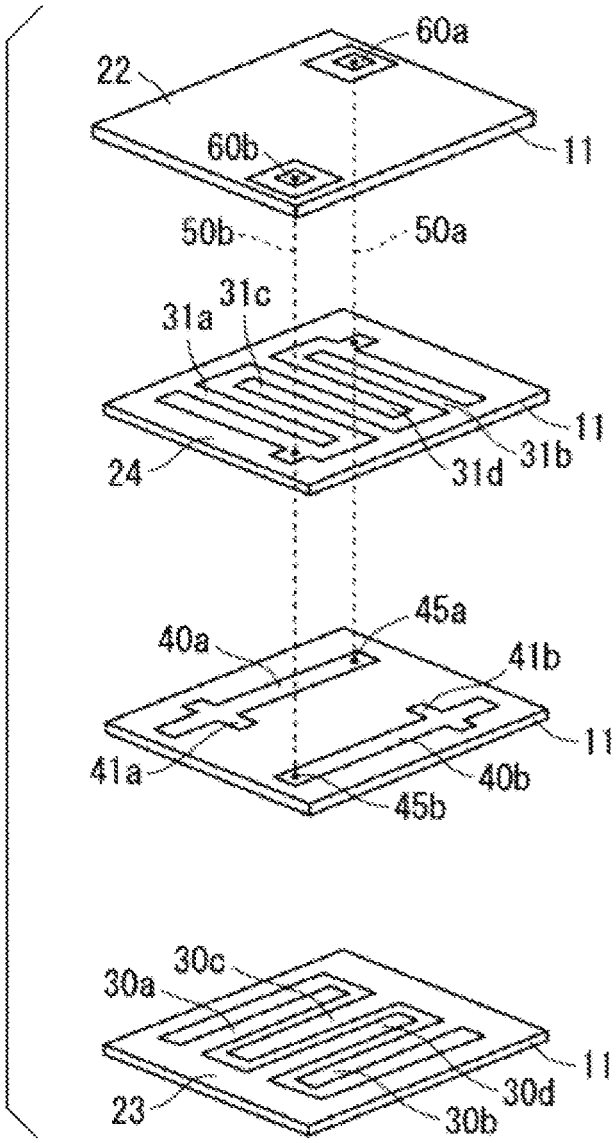
FIG. 2 is a schematic exploded perspective view of the bandpass filter shown in FIG. 1.
Figure 3:
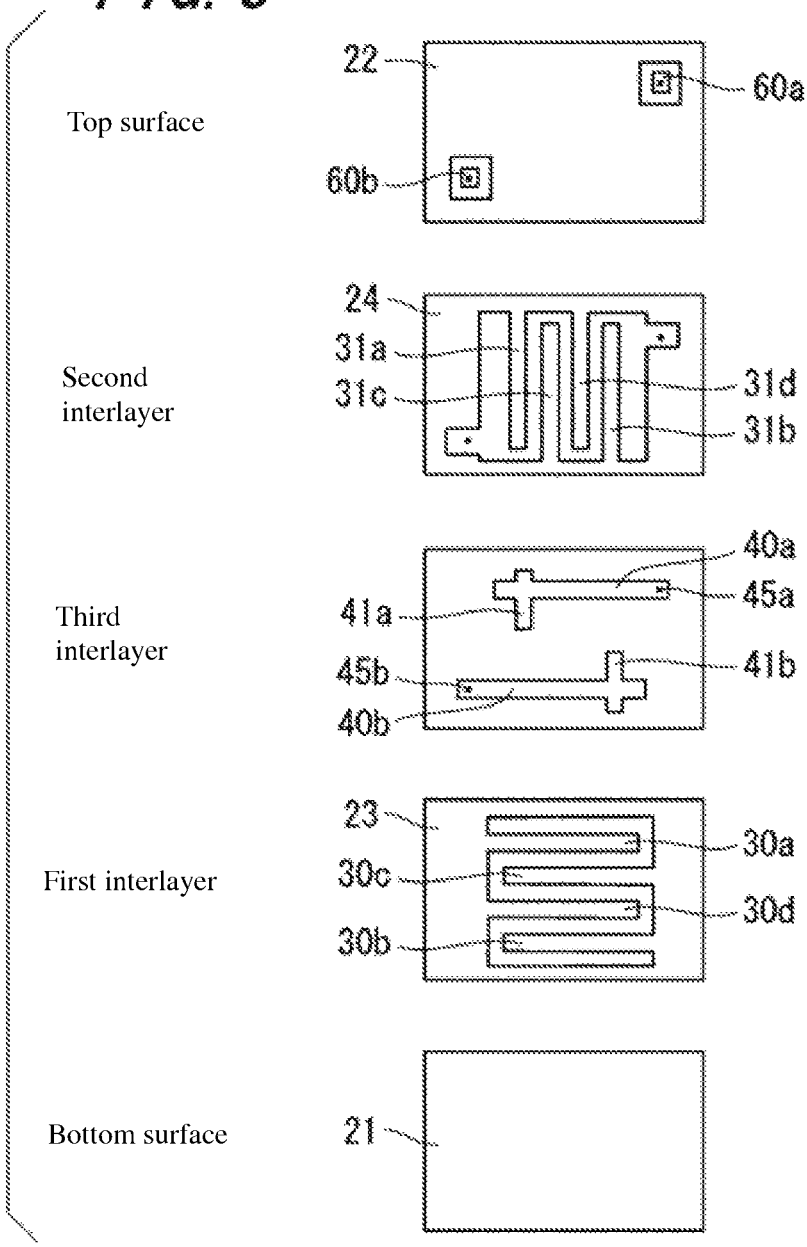
FIG. 3 is a plain view schematically showing the top and bottom surfaces and interlayer of the bandpass filter shown in FIG. 1.
Figure 4:
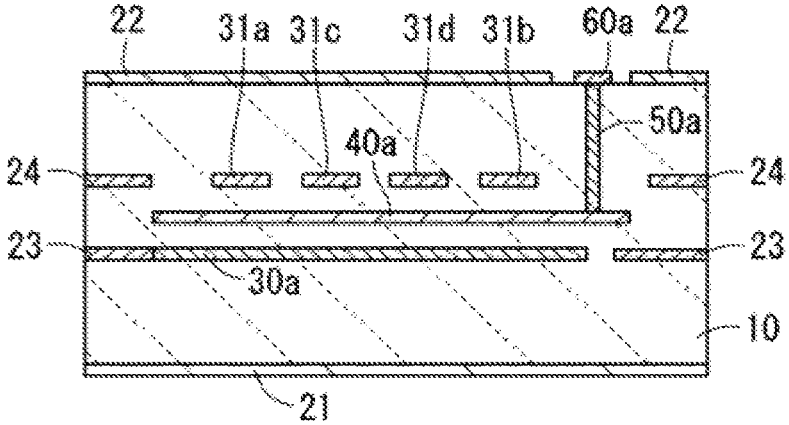
FIG. 4 is a cross-sectional view taken from the line P-P' shown in FIG. 1.

FIG. 1 is an external perspective view schematically showing the bandpass filter according to the first embodiment of the present invention. FIG. 2 is a schematic exploded perspective view of the bandpass filter shown in FIG. 1. FIG. 3 is a plain view schematically showing the top and bottom surfaces and interlayer of the bandpass filter shown in FIG. 1. FIG. 4 is a cross-sectional view taken from the line P-P' shown in FIG. 1.

The bandpass filter of this embodiment comprises a laminated body 10, a first ground electrode 21, a second ground electrode 22, a plurality of strip-shaped first resonance electrodes 30*a*, 30*b*, 30*c*, 30*d*, and a plurality of strip-shaped second resonance electrodes 31*a*, 31*b*, 31*c*, 31*d*, as shown in FIG. 1 to FIG. 4. The laminated body 10 comprises a plurality of laminated dielectric layers 11. The first ground electrode 21 is disposed on the bottom surface of the laminated body 10 and grounded. The second ground electrode 22 is disposed on the top surface of the laminated body 10, and is grounded. The plurality of first resonance electrodes 30*a*, 30*b*, 30*c*, 30*d* are disposed side by side on a first interlayer of the laminated body 10 so as to be electromagnetically coupled to each other, and so that each one end thereof is grounded, functioning as a resonator that resonates at a first frequency. The plurality of second resonance electrodes 31*a*, 31*b*, 31*c*, 31*d* are disposed side by side on a second interlayer different from the first interlayer of the laminated body 10 so as to be electromagnetically coupled to each other, and each one end thereof is grounded so as to resonate at a second frequency which is higher than the first frequency.

Additionally, the bandpass filter of this embodiment comprises a strip-shaped first input coupling electrode 40*a*, a strip-shaped first output coupling electrode 40*b*, a second input coupling electrode 41*a*, and a second output coupling electrode 41*b*. The first input coupling electrode 40*a* is disposed on a third interlayer located between the first interlayer and the second interlayer of the laminated body 10, facing a region over more than half the length, in the longitudinal direction, of the first resonance electrode 30*a* on the input stage and electromagnetically coupled to the region, and has an electrical signal input point 45*a* into which electrical signals are input. The first output coupling electrode 40*b* is disposed on a third interlayer of the laminated body 10, facing a region over more than half the length, in the longitudinal direction, of the first resonance electrode 30*b* on the output stage and electromagnetically coupled to the region, and has an electrical signal output point 45*b* from which electrical signals are output. The second input coupling electrode 41*a* is disposed on the third interlayer of the laminated body 10, and facing the second resonance electrode 31*a* on the input stage and electromagnetically coupled to the second resonance electrode 31*a*. The second output coupling electrode 41*b* is disposed on the third interlayer of the laminated body 10, and facing the second resonance electrode 31*b* on the output stage and electromagnetically coupled to the second resonance electrode 31*b*. However, the first input coupling electrode 40*a* is integrated with the second input coupling electrode 41*a*, and the first output coupling electrode 40*b* is integrated with the second output coupling electrode 41*b*.

Furthermore, the bandpass filter of this embodiment comprises a first annular ground electrode 23 and a second annular ground electrode 24. The first annular ground electrode 23 is annularly formed on the first interlayer of the laminated body 10 so as to surround the circumference of the plurality of first resonance electrodes 30*a*, 30*b*, 30*c*, 30*d*, is connected to one end of the plurality of first resonance electrodes 30*a*, 30*b*, 30*c*, 30*d*, and is connected to the ground potential. The second annular ground electrode 24 is annularly formed on the second interlayer so as to surround the circumference of the plurality of second resonance electrodes 31*a*, 31*b*, 31*c*, 31*d*, is connected to the one end of the plurality of second resonance electrodes 31*a*, 31*b*, 31*c*, 31*d*, and is connected to the ground potential.

Furthermore, in the bandpass filter of this embodiment, the first input coupling electrode 40*a* is connected to an input terminal electrode 60*a* disposed on the top surface of the laminated body 10 via a through-conductor 50*a* that penetrates a dielectric layer 11, and the first output coupling electrode 40*b* is connected to an output terminal electrode 60*b* disposed on the top surface of the laminated body 10 via a through-conductor 50*b* that penetrates the dielectric layer 11. Accordingly, the connection point between the first input coupling electrode 40*a* and the through-conductor 50*a* is an electrical signal input point 45*a* in the first input coupling electrode 40*a*, and the connection point between the first output coupling electrode 40*b* and the through-conductor 50*b* is an electrical signal output point 45*b* in the first output coupling electrode 40*b*.

In the bandpass filter of this embodiment comprising such a configuration, if electrical signals are input from an external circuit into the first input coupling electrode 40*a* via the input terminal electrode 60*a* and the through-conductor 50*a*, the first resonance electrode 30*a* on the input stage that is electromagnetically coupled to the first input coupling electrode 40*a* becomes excited, the plurality of first resonance electrodes 30*a*, 30*b*, 30*c*, 30*d* that are electromagnetically coupled to each other resonate; thus, electrical signals are output to the external circuit from the first output coupling electrode 40*b* that is electromagnetically coupled to the first resonance electrode 30*b* on the output stage via the through-conductor 50*b* and the output terminal electrode 60*b*. At this time, signals of a first frequency band, including the first frequency, in which the plurality of first resonance electrodes 30*a*, 30*b*, 30*c*, 30*d* resonate, pass through selectively; hence, the first passband is formed. Additionally, at the same time, electrical signals are also input from an external circuit into the second input coupling electrode 41*a* via the input terminal electrode 60*a*, the through-conductor 50*a*, and the first input coupling electrode 40*a*; hence, if the second resonance electrode 31*a* on the input stage that is electromagnetically coupled to the second input coupling electrode 41*a* becomes excited, the plurality of second resonance electrodes 31*a*, 31*b*, 31*c*, 31*d* that are electromagnetically coupled to each other resonate; thus, electrical signals are output to the external circuit from the second output coupling electrode 41*b* that is electromagnetically coupled to the second resonance electrode 31*b* on the output stage via the first output coupling electrode 40*b*, the through-conductor 50*b*, and the output terminal electrode 60*b*. At this time, signals of a second frequency band including the second frequency, in which the plurality of second resonance electrodes 31*a*, 31*b*, 31*c*, 31*d* resonate, pass through selectively; hence, the second passband is formed. In this way, the bandpass filter of this embodiment functions as a bandpass filter comprising two passbands with different frequencies.

In the bandpass filter of this embodiment, the electric length of the plurality of strip-shaped first resonance electrodes 30*a*, 30*b*, 30*c*, 30*d* is set to be approximately ¼ of the wavelength at the first frequency, and one end thereof is respectively connected to the first annular ground electrode 23, resulting in their functioning as a ¼ wavelength resonator. Similarly, the electric length of the plurality of strip-shaped second resonance electrodes 31*a*, 31*b*, 31*c*, 31*d* is set to be approximately ¼ of the wavelength at the second frequency, one end thereof is respectively connected to the second annular ground electrode 24, resulting in their functioning as a ¼ wavelength resonator. Additionally, the plurality of first resonance electrodes 30*a*, 30*b*, 30*c*, 30*d* are disposed side by side on the first interlayer of the laminated body 10 so as to alternate each one end and electromagnetically coupled in an inter-digital form, and the plurality of second resonance electrodes 31*a*, 31*b*, 31*c*, 31*d* are disposed side by side on the second interlayer of the laminated body 10 so as to alternate each one end and electromagnetically coupled in an inter-digital form.

Accordingly, with a strong coupling of the inter-digital form in which coupling via the magnetic field and coupling via the electric field are added, it is possible to make the interval between the resonance frequencies of each resonant mode forming the passband an appropriate one for obtaining a substantially wide passband width exceeding 10% of the fractional bandwidth. Stronger coupling can be obtained with smaller intervals between each of resonance electrodes that are disposed side by side; however, this causes difficulty in manufacturing if the intervals are smaller; therefore, it is set to be, for example, approximately 0.05 to 0.5 mm.

Furthermore, in the bandpass filter of this embodiment, it is preferable that a dimension of the first input coupling electrode 40*a* and the first output coupling electrode 40*b* be set to be approximately the same as those of the first resonance electrode 30*a* on the input stage and the first resonance electrode 30*b* on the output stage. Additionally, stronger coupling can be obtained with smaller intervals between the first input coupling electrode 40*a* and the first output coupling electrode 40*b*, and the first resonance electrode 30*a* on the input stage and the first resonance electrode 30*b* on the output stage, as well as between the second input coupling electrode 41*a* and the second output coupling electrode 41*b*, and the second resonance electrode 31*a* on the input stage and the second resonance electrode 31*b* on the output stage; however, this causes difficulty in manufacturing; hence, it is set to be, for example, approximately 0.01 to 0.5 mm.

Furthermore, in the bandpass filter of this embodiment, the second input coupling electrode 41*a* has a strip-shaped shape, is disposed so as to face along the second resonance electrode 31*a* on the input stage, and is integrated with the first input coupling electrode 40*a* so as to intersect with the first input coupling electrode 40*a*. Therefore, a part, in which the first input coupling electrode 40*a* and the second input coupling electrode 41*a* intersect, functions as the first input coupling electrode 40*a*, and also functions as the second input coupling electrode 41*a*. Additionally, the second output coupling electrode 41*b* has a strip-shaped shape, is disposed so as to face along the second resonance electrode 31*b* on the output stage, and is integrated with the first output coupling electrode 40*b* so as to intersect with the first output coupling electrode 40*b*. Therefore, a part, in which the first output coupling electrode 40*b* and the second output coupling electrode 41*b* intersect, functions as the first output coupling electrode 40*b*, and also functions as the second output coupling electrode 41*b*. The lengths of the second input coupling electrode 41*a* and the second output coupling electrode 41*b* are appropriately set depending on a required coupling amount.

According to the bandpass filter of this embodiment, the plurality of first resonance electrodes 30*a*, 30*b*, 30*c*, 30*d*, and the plurality of second resonance electrodes 31*a*, 31*b*, 31*c*, 31*d* are disposed orthogonally to each other if seen from the direction of lamination of the laminated body 10. Therefore, the electromagnetic coupling generated between the plurality of first resonance electrodes 30*a*, 30*b*, 30*c*, 30*d* and the plurality of second resonance electrode 31*a*, 31*b*, 31*c*, 31*d* can be minimized even in cases in which the thickness of the laminated body 10 is thinner and the plurality of first resonance electrodes 30*a*, 30*b*, 30*c*, 30*d* are in the close vicinity of the plurality of second resonance electrodes 31*a*, 31*b*, 31*c*, 31*d*; hence, deterioration of the bandpass characteristics in the passband, resulting from electromagnetic coupling becoming too strong between the plurality of first resonance electrodes

30*a*, 30*b*, 30*c*, 30*d* and the plurality of second resonance electrodes 30*a*, 30*b*, 30*c*, 30*d*, can be prevented.

Additionally, according to the bandpass filter of this embodiment, the first input coupling electrode 40*a* is facing a region over the entire length, in the longitudinal direction, of the first resonance electrode 30*a* on the input stage via the dielectric layer 11 and electromagnetically coupled to the region, the first output coupling electrode 40*b* is facing a region over the entire length, in the longitudinal direction, of the first resonance electrode 30*b* on the output stage via the dielectric layer 11 and electromagnetically coupled to the region, the second input coupling electrode 41*a* is connected to the side farther from the electrical signal input point 45*a* than the center, in the longitudinal direction, of the portion facing the first resonance electrode 30*a* on the input stage of the first input coupling electrode 40*a* so that electrical signals are input via the first input coupling electrode 40*a*, and the second output coupling electrode 41*b* is connected to the side farther from the electrical signal output point 45*b* than the center, in the longitudinal direction, of the portion facing the first resonance electrode 30*b* on the output stage of the first output coupling electrode 40*b* so that electrical signals are output via the first output coupling electrode 40*b*. In this way, the electromagnetic coupling of the first coupling electrode 40*a* with the first resonance electrode 30*a* on the input stage and the electromagnetic coupling of the first output coupling electrode 40*b* with the first resonance electrode 30*b* on the output stage can be sufficiently strengthened; hence, a bandpass filter comprising excellent bandpass characteristics, in which it is flat and low-loss across the entire wide passband formed by the plurality of first resonance electrodes 30*a*, 30*b*, 30*c*, 30*d*, can be obtained. This effect is described below.

To obtain excellent bandpass characteristics, in which it is flat and low-loss across the entire substantially wide passband exceeding 10% of the fractional bandwidth, it is necessary to make the electromagnetic coupling of the resonance electrode on the input stage with the input coupling electrode and the electromagnetic coupling of the resonance electrode on the output stage with the output coupling electrode substantially strong. However, the inventor of the present application have discovered in studies that excellent bandpass characteristics cannot be obtained in the passband formed by the first resonance electrodes 30*a*, 30*b*, 30*c*, 30*d*, because electromagnetic coupling of the first resonance electrode 30*a* on the input stage with the first input coupling electrode 40*a*, and electromagnetic coupling of the first resonance electrode 30*b* on the output stage with the first output coupling electrode 40*b* become insufficient, by simply connecting the first input coupling electrode 40*a* facing the first resonance electrode 30*a* on the input stage and electromagnetically coupled to the first resonance electrode 30*a* to the second input coupling electrode 41*a* facing the second resonance electrode 31*a* on the input stage and electromagnetically coupled to the second resonance electrode 31*a*, and by connecting the first output coupling electrode 40*b* facing the first resonance electrode 30*b* on the output stage and electromagnetically coupled to the first resonance electrode 30*b* to the second output coupling electrode 41*b* facing the second resonance electrode 31*b* on the output stage and electromagnetically coupled to the second resonance electrode 31*b*.

Therefore, after performing various studies, the inventor have discovered that the electromagnetic coupling of the first input coupling electrode 40*a* with the first resonance electrode 30*a* on the input stage can be sufficiently strengthened by providing the electrical signal input point 45*a* into which electrical signals are input to the first input coupling electrode 40*a*, connecting the second input coupling electrode 41*a* to the first input coupling electrode 40*a* so that the electrical signals are input via the first input coupling electrode 40*a*, as well as providing a location at which the second input coupling electrode 41*a* is connected to the first input coupling electrode 40*a* to the side farther from the electrical signal input point 45*a* than the center, in the longitudinal direction, of the portion facing the first resonance electrode 30*a* on the input stage on the first input coupling electrode 40*a*. The reason that such effects are obtained is considered attributable to the notion that current flowing in the portion facing the first resonance electrode 30*a* on the input stage of the first input coupling electrode 40*a* can be sufficiently secured by connecting the second input coupling electrode 41*a* to the side farther from the electrical signal input point 45*a* than the center, in the longitudinal direction, of the portion facing the first resonance electrode 30*a* on the input stage of the first input coupling electrode 40*a*, so that electrical signals are input via the first input coupling electrode 40*a*.

Similarly, the electromagnetic coupling of the first output coupling electrode 40*b* with the first resonance electrode 30*b* on the output stage can be sufficiently strengthened by providing the electrical signal output point 45*b* from which electrical signals are output to the first output coupling electrode 40*b*, connecting the second output coupling electrode 41*b* to the first output coupling electrode 40*b* so that the electrical signals are output via the first output coupling electrode 40*b*, as well as providing a location at which the second output coupling electrode 41*b* is connected to the first output coupling electrode 40*b* to the side farther from the electrical signal output point 45*b* than the center, in the longitudinal direction, of the portion facing the first resonance electrode 30*b* on the output stage on the first output coupling electrode 40*b*.

Furthermore, according to the bandpass filter of this embodiment, the electromagnetic coupling of the first input coupling electrode 40*a* with the first resonance electrode 30*a* on the input stage, and the electromagnetic coupling of the first output coupling electrode 40*b* with the first resonance electrode 30*b* on the output stage can be further strengthened because the electrical signal input point 45*a* is located on an end portion, in the longitudinal direction, facing the first resonance electrode 30*a* on the input stage of the first input coupling electrode 40*a*, and the electrical signal output point 45*b* is located on an end portion, in the longitudinal direction, facing the first resonance electrode 30*b* on the output stage of the first output coupling electrode 40*b*.

Furthermore, according to the bandpass filter of this embodiment, the electrical signal input point 45*a* is located on the side farther from the one end (ground end) of the first resonance electrode 30*a* on the input stage than the center, in the longitudinal direction, of the portion facing the first resonance electrode 30*a* on the input stage of the first input coupling electrode 40*a*, and the electrical signal output point 45*b* is located on the side farther from the one end (ground end) of the first resonance electrode 30*b* on the output stage than the center, in the longitudinal direction, of the portion facing the first resonance electrode 30*b* on the output stage of the first output coupling electrode 40*b*. Therefore, the first input coupling electrode 40*a* is electromagnetically coupled to the first resonance electrode 30*a* on the input stage in an inter-digital form, and the first output coupling electrode 40*b* is electromagnetically coupled to the first resonance electrode 30*b* on the output stage in an inter-digital form; hence, the electromagnetic coupling of the first input coupling electrode 40*a* with the first resonance electrode 30*a* on the input stage and the electromagnetic coupling of the first output coupling electrode 40*b* with the first resonance electrode 30*b* on the output stage can be further strengthened.

Furthermore, according to the bandpass filter of this embodiment, the second input coupling electrode 41*a* is disposed so as to face the one end (ground end) side than the center, in the longitudinal direction, of the first resonance electrode 30*a* on the input stage, and the second output coupling electrode 41*b* is disposed so as to face the one end (ground end) side than the center, in the longitudinal direction, of the first resonance electrode 30*b* on the output stage. In this way, the electrical coupling can be reduced between the second input coupling electrode 41*a* and the first resonance electrode 30*a* on the input stage, and the electrical coupling can be reduced between the second output coupling electrode 41*b* and the first resonance electrode 30*b* on the output stage; hence, deterioration of the filter characteristics, which is attributed to unnecessary electromagnetic couplings becoming strong between the second input coupling electrode 41*a* and the first resonance electrode 30*a* on the input stage and between the second output coupling electrode 41*b* and the first resonance electrode 30*b* on the output stage, can be prevented.

Furthermore, according to the bandpass filter of this embodiment, the second input coupling electrode 41*a* is disposed on the third interlayer such that it is integrated with the first input coupling electrode 40*a*, and the second output coupling electrode 41*b* is disposed on the third interlayer such that it is integrated with the first output coupling electrode 40*b*. Therefore, a connecting conductor for connecting the first input coupling electrode 40*a* with the second input coupling electrode 41*a* and a connecting conductor for connecting the first output coupling electrode 40*b* with the second output coupling electrode 41*b* are not necessary; hence, a thin bandpass filter, in which the loss caused by the connecting conductors can be eliminated and in which it comprises a simple structure, can be obtained.

Furthermore, according to the bandpass filter of this embodiment, one end of the first resonance electrode 30*a* on the input stage and one end of the first resonance electrode 30*b* on the output stage are disposed alternately, and one end of the second resonance electrode 31*a* on the input stage and one end of the second resonance electrode 31*b* on the output stage are disposed alternately. Accordingly, a bandpass filter, in which the electromagnetic coupling of the first input coupling electrode 40*a* with the first resonance electrode 30*a* on the input stage and the first output coupling electrode 40*b* with the first resonance electrode 30*b* on the output stage are sufficiently strong, and in which it comprises a symmetrical structure and circuit configuration, can be obtained.

Second Embodiment

Figure 5:
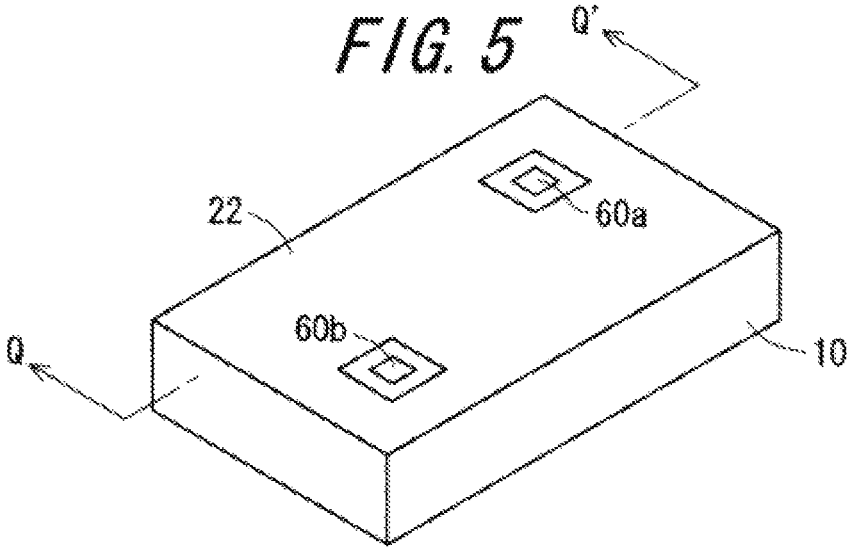
FIG. 5 is an external perspective view schematically showing the bandpass filter according to the second embodiment of the present invention.
Figure 6:
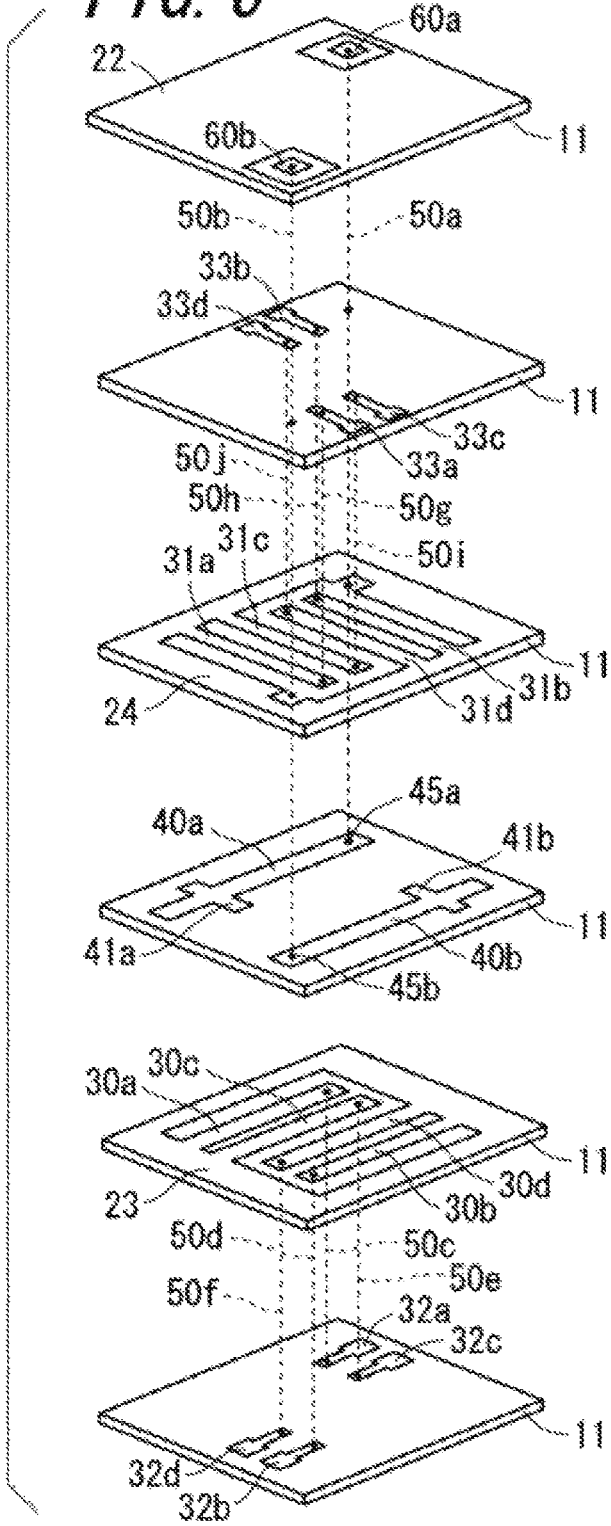
FIG. 6 is a schematic exploded perspective view of the bandpass filter shown in FIG. 5.
Figure 7:
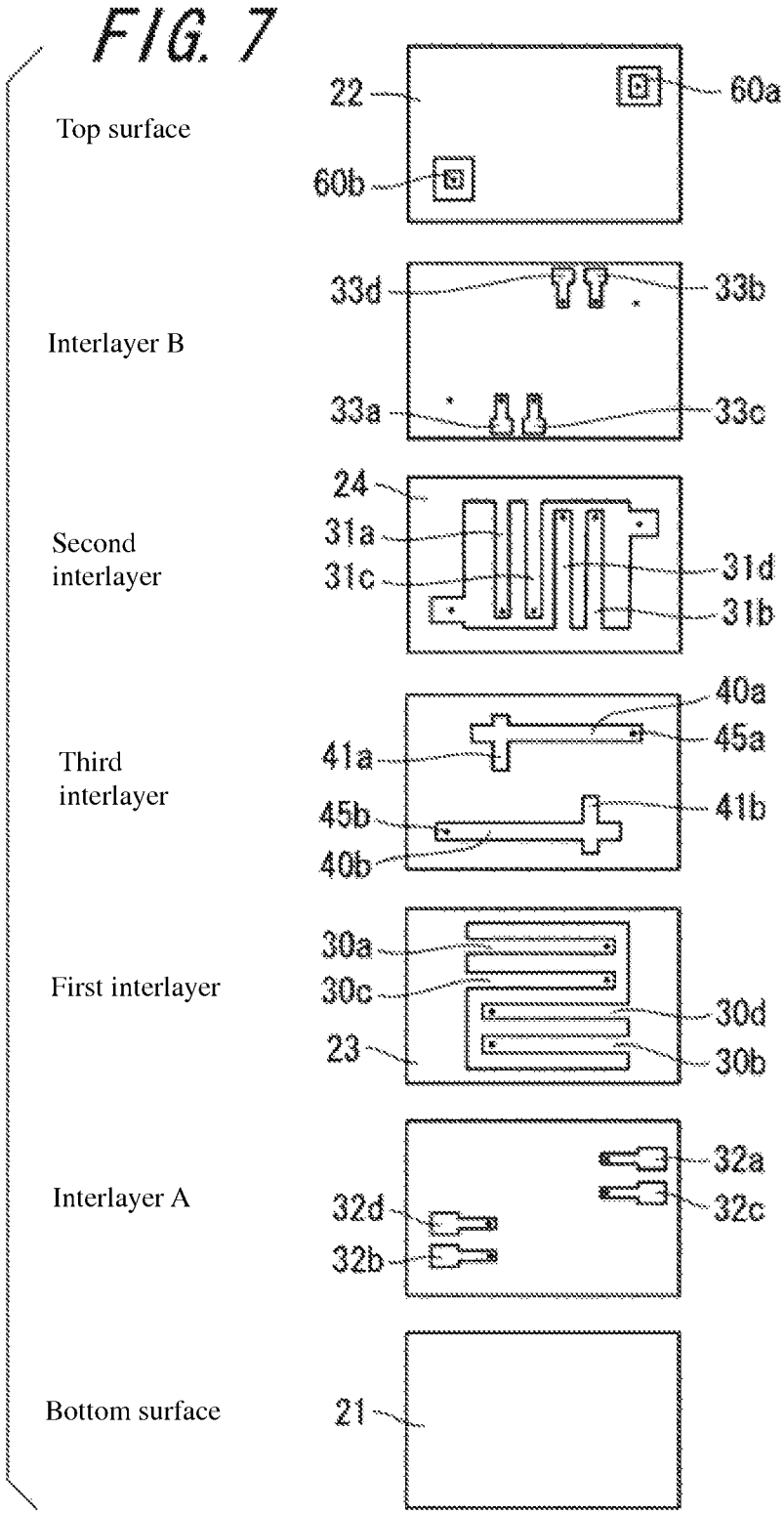
FIG. 7 is a plain view schematically showing the top and bottom surfaces and interlayer of the bandpass filter shown in FIG. 5.
Figure 8:
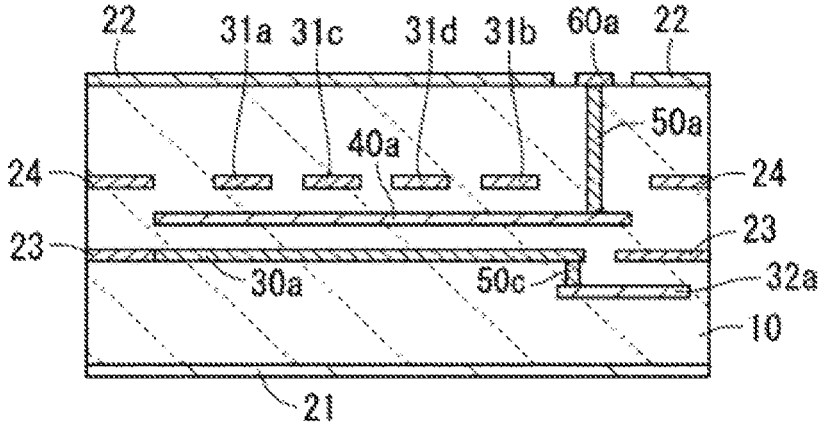
FIG. 8 is a cross-sectional view taken from the line Q-Q' shown in FIG. 5.

FIG. 5 is an external perspective view schematically showing the bandpass filter according to the second embodiment of the present invention. FIG. 6 is a schematic exploded perspective view of the bandpass filter shown in FIG. 5. FIG. 7 is a plain view schematically showing the top and bottom surfaces and interlayer of the bandpass filter shown in FIG. 5. FIG. 8 is a cross-sectional view taken from the line Q-Q' shown in FIG. 5. In addition, in this embodiment, only aspects different from the abovementioned first embodiment are explained so as to omit redundant explanations, and the same reference characters are used for similar components.

In the bandpass filter of this embodiment, as shown in FIG. 5 to FIG. 8, the first resonance electrodes 30*a*, 30*c* are electromagnetically coupled to each other in a comb-line form, the first resonance electrodes 30*b*, 30*d* are electromagnetically coupled to each other in a comb-line form, the second resonance electrodes 31*a*, 31*c* are electromagnetically coupled to each other in a comb-line form, and the second resonance electrodes 31*b*, 31*d* are electromagnetically coupled to each other in a comb-line form. However, the first resonance electrodes 30*c*, 30*d* are electromagnetically coupled to each other in an inter-digital form, the second resonance electrodes 31*c*, 31*d* are electromagnetically coupled to each other in an inter-digital form.

Additionally, in the bandpass filter of this embodiment, first resonance auxiliary electrodes 32*a*, 32*b*, 32*c*, 32*d* are disposed on an interlayer A located between the bottom surface and the first interlayer of the laminated body 10 so as to have a region facing the first annular ground electrode 23 and a region facing the first resonance electrodes 30*a*, 30*b*, 30*c*, 30*d*. The first resonance auxiliary electrodes 32*a*, 32*b*, 32*c*, 32*d* are connected to the other end side of the first resonance electrodes 30*a*, 30*b*, 30*c*, 30*d*, respectively, via through-conductors 50*c*, 50*d*, 50*e*, 50*f*, through which the region facing the first resonance electrodes 30*a*, 30*b*, 30*c*, 30*d* penetrates the dielectric layer 11, and are disposed corresponding to each of the first resonance electrodes 30*a*, 30*b*, 30*c*, 30*d*. Additionally, second resonance auxiliary electrode 33*a*, 33*b*, 33*c*, 33*d* are disposed on an interlayer B located between the top surface and the second interlayer of the laminated body 10 so as to have a region facing the second annular ground electrode 24 and a region facing the second resonance electrodes 31*a*, 31*b*, 31*c*, 31*d*. The second resonance auxiliary electrodes 33*a*, 33*b*, 33*c*, 33*d* are connected to the other end side of the second resonance electrodes 31*a*, 31*b*, 31*c*, 31*d*, respectively, via through-conductors 50*g*, 50*h*, 50*i*, 50*j*, through which the regions facing the second resonance electrodes 31*a*, 31*b*, 31*c*, 31*d* penetrate the dielectric layer 11, and are disposed so as to correspond to each of the second resonance electrodes 31*a*, 31*b*, 31*c*, 31*d*.

According to the bandpass filter of this embodiment comprising such a structure, capacitance generated between the first resonance auxiliary electrodes 32*a*, 32*b*, 32*c*, 32*d* and the first annular ground electrode 23 is added to capacitance generated between the first resonance electrodes 30*a*, 30*b*, 30*c*, 30*d* and the ground potential. Therefore, the lengths of the first resonance electrodes 30*a*, 30*b*, 30*c*, 30*d* can be shortened. Similarly, the length of the second resonance electrodes 31*a*, 31*b*, 31*c*, 31*d* can be reduced by the second resonance auxiliary electrodes 33*a*, 33*b*, 33*c*, 33*d*. Therefore, a more compact bandpass filter can be obtained.

However, the area of the part in which the first resonance auxiliary electrodes 32*a*, 32*b*, 32*c*, 32*d* and the first annular ground electrode 23 face each other, and the area of the part in which the second resonance auxiliary electrodes 33*a*, 33*b*, 33*c*, 33*d* and the second annular ground electrode 24 face each other, are set to be approximately 0.01 to 3 $mm^2$, for example, depending on required capacitance. Greater capacitance can be generated if the interval are shorter between the first resonance auxiliary electrodes 32*a*, 32*b*, 32*c*, 32*d* and the first annular ground electrode 23, and the interval between the second resonance auxiliary electrodes 33*a*, 33*b*, 33*c*, 33*d* and the second annular ground electrode 24; however, this causes difficulty in manufacturing; hence, the intervals are set to be, for example, approximately 0.01 to 0.5 mm.

Third Embodiment

Figure 9:
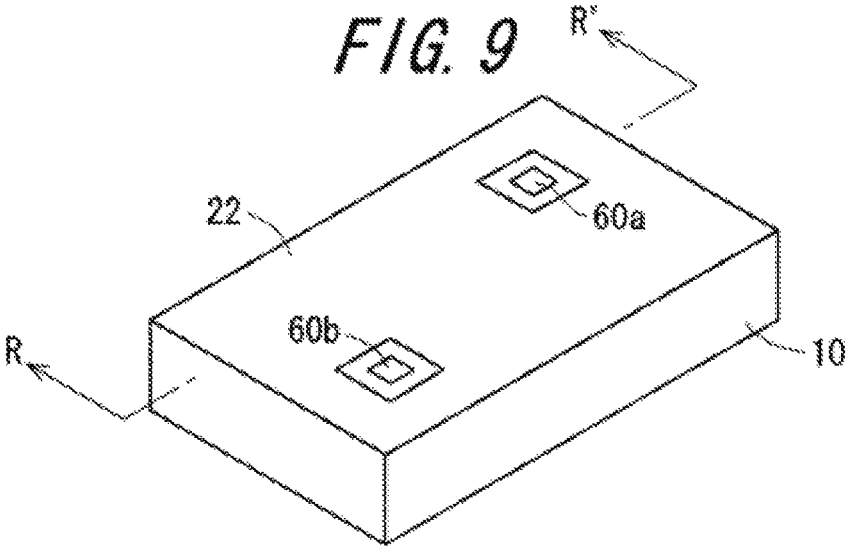
FIG. 9 is an external perspective view schematically showing the bandpass filter according to the third embodiment of the present invention.
Figure 10:
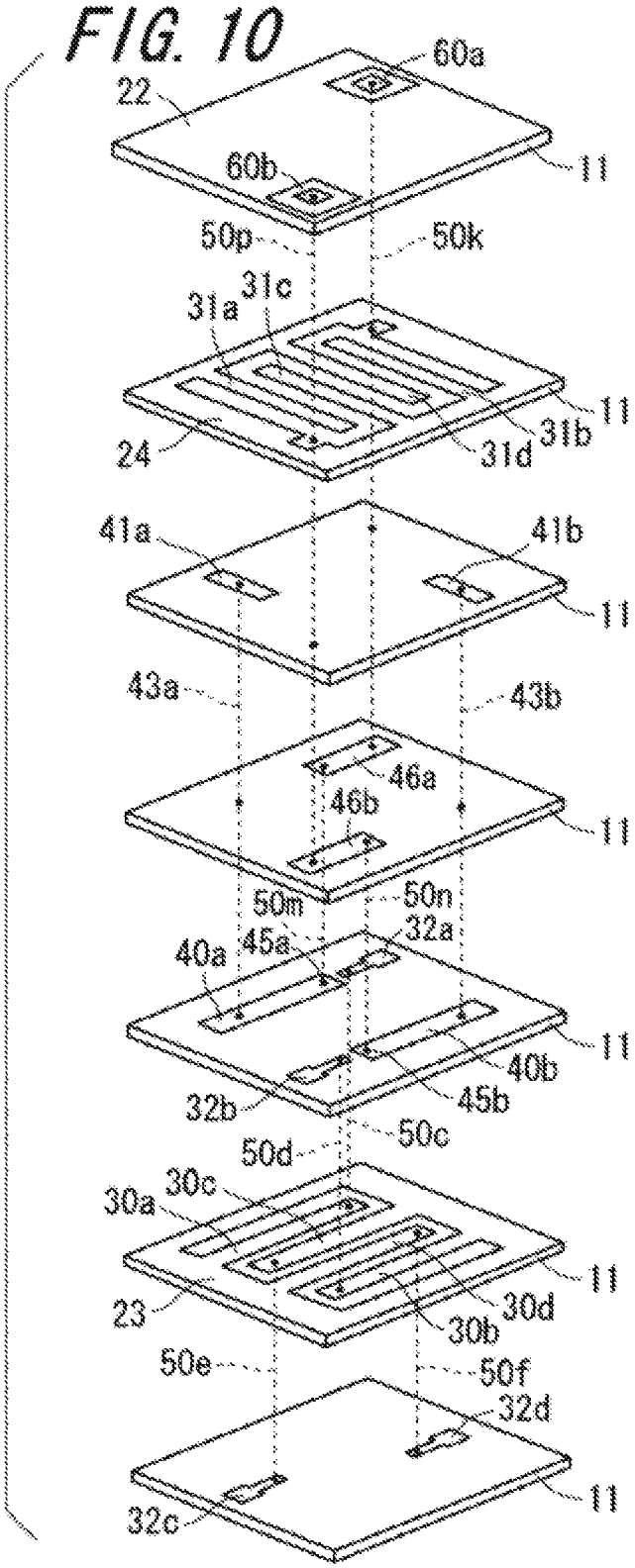
FIG. 10 is a schematic exploded perspective view of the bandpass filter shown in FIG. 9.
Figure 11:
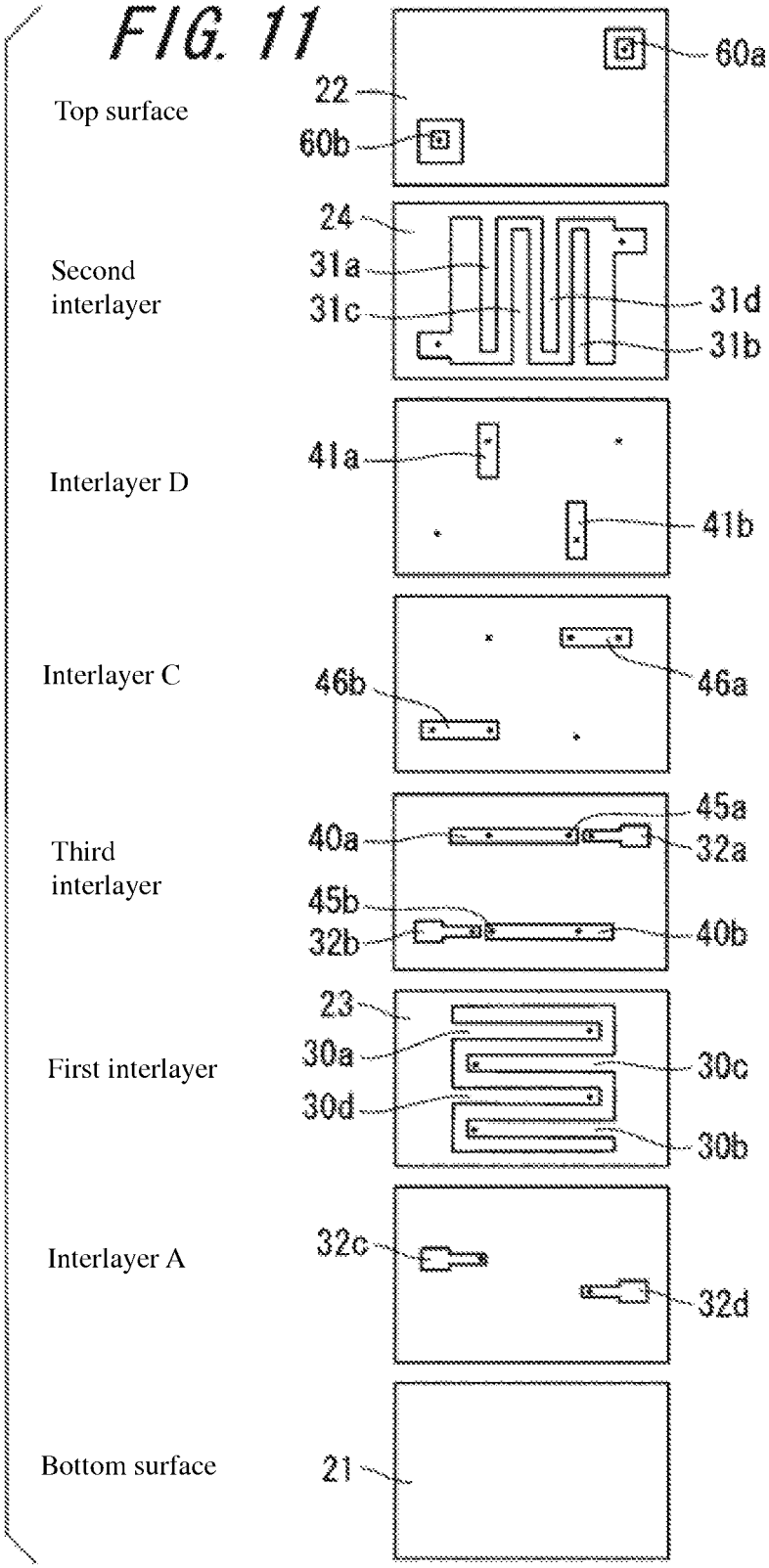
FIG. 11 is a plain view schematically showing the top and bottom surfaces and interlayer of the bandpass filter shown in FIG. 9.
Figure 12:
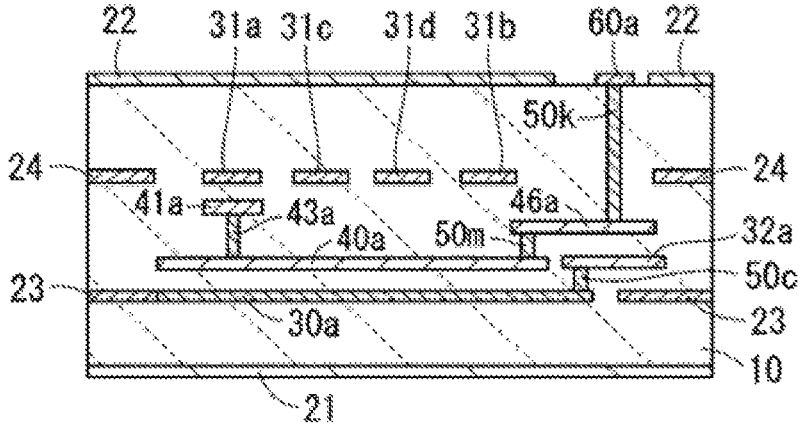
FIG. 12 is a cross-sectional view taken from the line R-R' shown in FIG. 9.

FIG. 9 is an external perspective view schematically showing the bandpass filter according to the third embodiment of the present invention. FIG. 10 is a schematic exploded perspective view of the bandpass filter shown in FIG. 9. FIG. 11 is a plain view schematically showing the top and bottom surfaces and interlayer of the bandpass filter shown in FIG. 9. FIG. 12 is a cross-sectional view taken from the line R-R' of the bandpass filter shown in FIG. 9. In addition, in this embodiment, only aspects different from the abovementioned first embodiment are explained so as to omit redundant explanations, and the same reference characters are used for similar components.

In the bandpass filter of this embodiment, as shown in FIG. 9 to FIG. 12, the first resonance coupling auxiliary electrodes 32*c*, 32*d* are disposed on an interlayer A located between the bottom layer and a first interlayer of the laminated body 10 so as to have a region facing the first annular ground electrode 23 and a region facing the first resonance electrodes 30*c*, 30*d*. The first resonance auxiliary electrodes 32*c*, 32*d* are connected to the other end side of the first resonance electrodes 30*c*, 30*d*, respectively, via through-conductors 50*e*, 50*f*, through which regions facing the first resonance electrodes 30*c*, 30*d* penetrate the dielectric layer 11, and are disposed so as to correspond to each of the first resonance electrodes 30*c*, 30*d*. Additionally, the first resonance auxiliary electrodes 32*a*, 32*b* are disposed on the third interlayer of the laminated body 10 so as to have a region facing the first annular ground electrode 23 and a region facing the first resonance electrodes 30*a*, 30*b*. The first resonance auxiliary electrodes 32*a*, 32*b* are connected to the other end side of the first resonance electrodes 30*a*, 30*b*, respectively, via through-conductors 50*c*, 50*d*, through which regions facing the first resonance electrodes 30*a*, 30*b* penetrate the dielectric layer 11, and are disposed so as to correspond to each of the first resonance electrodes 30*a*, 30*b*.

Additionally, the bandpass filter of this embodiment comprises an input coupling auxiliary electrode 46*a*. The input coupling auxiliary electrode 46*a* is disposed on an interlayer C located between the second interlayer and the third interlayer so as to have a region facing the first resonance auxiliary electrode 32*a* and a region facing the first input coupling electrode 40*a*, and a region facing the first input coupling electrode 40*a* is connected to the first input coupling electrode 40*a* via a through-conductor 50*m*, and a region facing the first resonance auxiliary electrode 32*a* is connected to the input terminal electrode 60*a* via a through-conductor 50*k*. Additionally, the bandpass filter of this embodiment comprises an output coupling auxiliary electrode 46*b*. The output coupling auxiliary electrode 46*b* is disposed on the interlayer C so as to have a region facing the first resonance auxiliary electrode 32*b* and a region facing the first output coupling electrode 40*b*, and a region facing the first output coupling electrode 40*b* is connected to the first output coupling electrode 40*b* via a through-conductor 50*n*, and a region facing the first resonance auxiliary electrode 32*b* is connected to the output terminal electrode 60*b* via a through-conductor 50*p*.

Furthermore, in the bandpass filter of this embodiment, the second input coupling electrode 41*a* and the second output coupling electrode 41*b* are connected to an interlayer D located between the second interlayer and the interlayer C, the second input coupling electrode 41*a* is connected to the first input coupling electrode 40*a* via an input side connecting conductor 43*a*, and the second output coupling electrode 41*b* is connected to the first output coupling electrode 40*b* via an output side connecting conductor 43*b*.

According to the bandpass filter of this embodiment comprising such a structure, capacitance generated between the first resonance auxiliary electrodes 32*a*, 32*b*, 32*c*, 32*d* and the first annular ground electrode 23 is added to capacitance generated between the first resonance electrodes 30*a*, 30*b*, 30*c*, 30*d* and the ground potential. Therefore, the lengths of the first resonance electrodes 30*a*, 30*b*, 30*c*, 30*d* can be shortened; hence, a more compact bandpass filter can be obtained.

Additionally, according to the bandpass filter of this embodiment, the electromagnetic coupling of the input coupling auxiliary electrode 46*a* with the first resonance auxiliary electrode 32*a* is added to the electromagnetic coupling of the first input coupling electrode 40*a* with the first resonance electrode 30*a* on the input stage, and the electromagnetic coupling of the output coupling auxiliary electrode 46*b* with the first resonance auxiliary electrode 32*b* is added to the electromagnetic coupling of the first output coupling electrode 40*b* with the first resonance electrode 30*b* on the output stage. Therefore, the electromagnetic coupling of the first coupling electrode 40*a* with the first resonance electrode 30*a* on the input stage, and the electromagnetic coupling of the first output coupling electrode 40*b* with the first resonance electrode 30*b* on the output stage are further strengthened; hence, in the passband formed by the plurality of first resonance electrodes 30*a*, 30*b*, 30*c*, 30*d* even if the passband is substantially wide, even more flat and even more low-loss bandpass characteristics, in which increase of insertion loss at frequencies located between the resonance frequencies in each of the resonance modes is further reduced, can be obtained across the entire substantially wide passband.

Furthermore, according to the bandpass filter of this embodiment, the second input coupling electrode 41*a* is disposed on the interlayer D that is in the closer vicinity of the second interlayer than the third interlayer; hence, the interval is maintained between the first input coupling electrode 40*a* and the first resonance electrode 30*a* on the input stage, and the interval between the second input coupling electrode 41*a* and the second resonance electrode 31*a* on the input stage, while the interval can be widened between the first resonance electrode 30*a* on the input stage and the second resonance electrode 31*a* on the input stage. Therefore, without weakening the electromagnetic coupling of the first input coupling electrode 40*a* with the first resonance electrode 30*a* on the input stage and the electromagnetic coupling of the second input coupling electrode 41*a* with the second resonance electrode 31*a* on the input stage, the electromagnetic coupling of the first resonance electrode 30*a* on the input stage with the second resonance electrode 31*a* on the input stage can be weakened, and in this way, the electromagnetic coupling of the first input coupling electrode 40*a* with the first resonance electrode 30*a* on the input stage, and the electromagnetic coupling of the second input coupling electrode 41*a* with the second resonance electrode 31*a* on the input stage can be further strengthened.

Additionally, according to the bandpass filter of this embodiment, because the second output coupling electrode 41*b* is disposed on the interlayer D that is in the closer vicinity of the second interlayer than the third interlayer, the interval is maintained between the first output coupling electrode 40*b* and the first resonance electrode 30*b* on the output stage and the interval between the second output coupling electrode 41*b* and the second resonance electrode 31*b* on the output stage, while the interval can be widened between the first resonance electrode 30*b* on the output stage and the second resonance electrode 31*b* on the output stage. Therefore, without weakening the electromagnetic coupling of the first output coupling electrode 40*b* with the first resonance electrode 30*b* on the output stage and the electromagnetic coupling of the second output coupling electrode 41*b* with the second resonance electrode 31*b* on the output stage, the electromagnetic coupling of the first resonance electrode 30*b* on the output stage with the second resonance electrode 31*b* on the output stage can be weakened, and in this way, the electromagnetic coupling of the first output coupling electrode 40*b* with the first resonance electrode 30*b* on the output stage, and the electromagnetic coupling of the second output coupling electrode 41*b* with the second resonance electrode 31*b* on the output stage can be further strengthened.

However, the widths of the input coupling auxiliary electrode 46*a* and the output coupling auxiliary electrode 46*b* are, for example, set to be approximately the same as those of the first input coupling electrode 40*a* and the first output coupling electrode 40*b*, and the lengths of the input coupling auxiliary electrode 46*a* and the output coupling auxiliary electrode 46*b* are, for example set to be slightly longer than the lengths of the first resonance auxiliary electrodes 32*a*, 32*b*. Shorter intervals are preferable between the input coupling auxiliary electrode 46*a* and the output coupling auxiliary electrode 46*b* and between the first resonance auxiliary electrodes 32*a*, 32*b* in view of generating stronger coupling; however, this causes difficulty in manufacturing; hence, the intervals are, for example, set to be approximately 0.01 to 0.5 mm.

Fourth Embodiment

Figure 13:
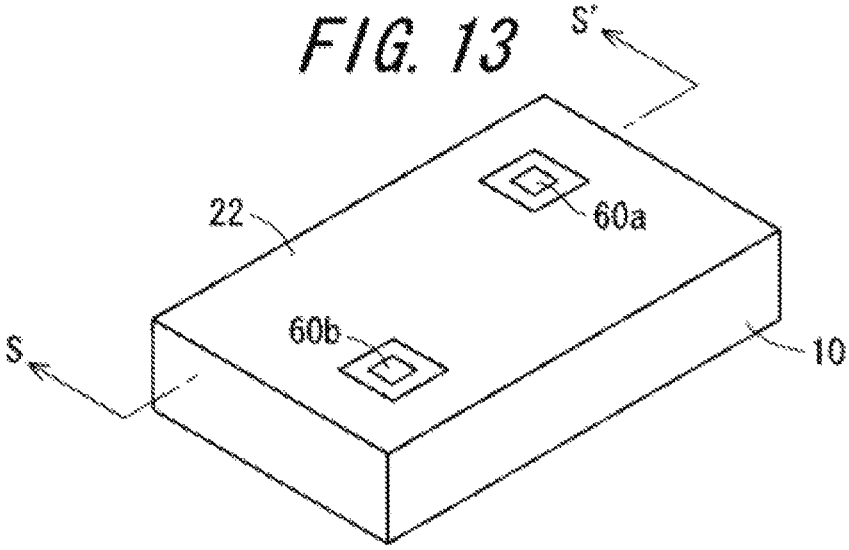
FIG. 13 is an external perspective view schematically showing the bandpass filter according to the fourth embodiment of the present invention.
Figure 14:
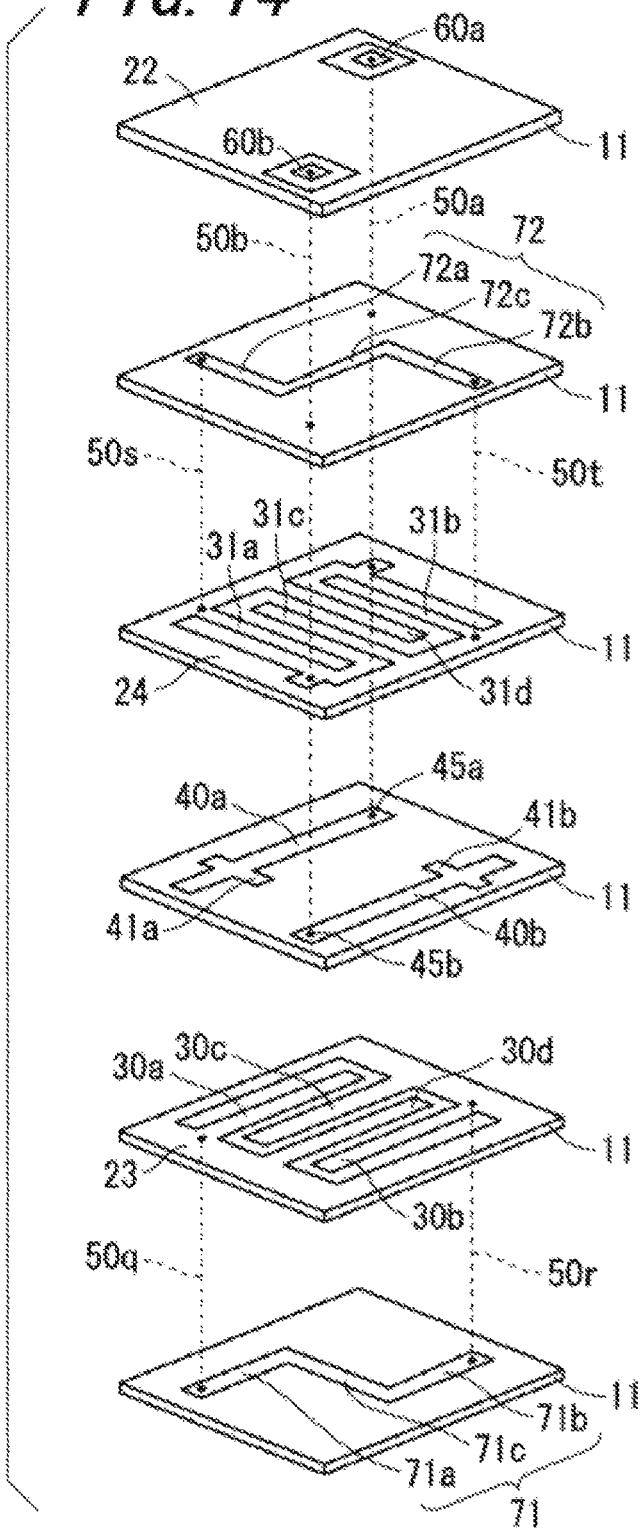
FIG. 14 is a schematic exploded perspective view of the bandpass filter shown in FIG. 13.
Figure 15:
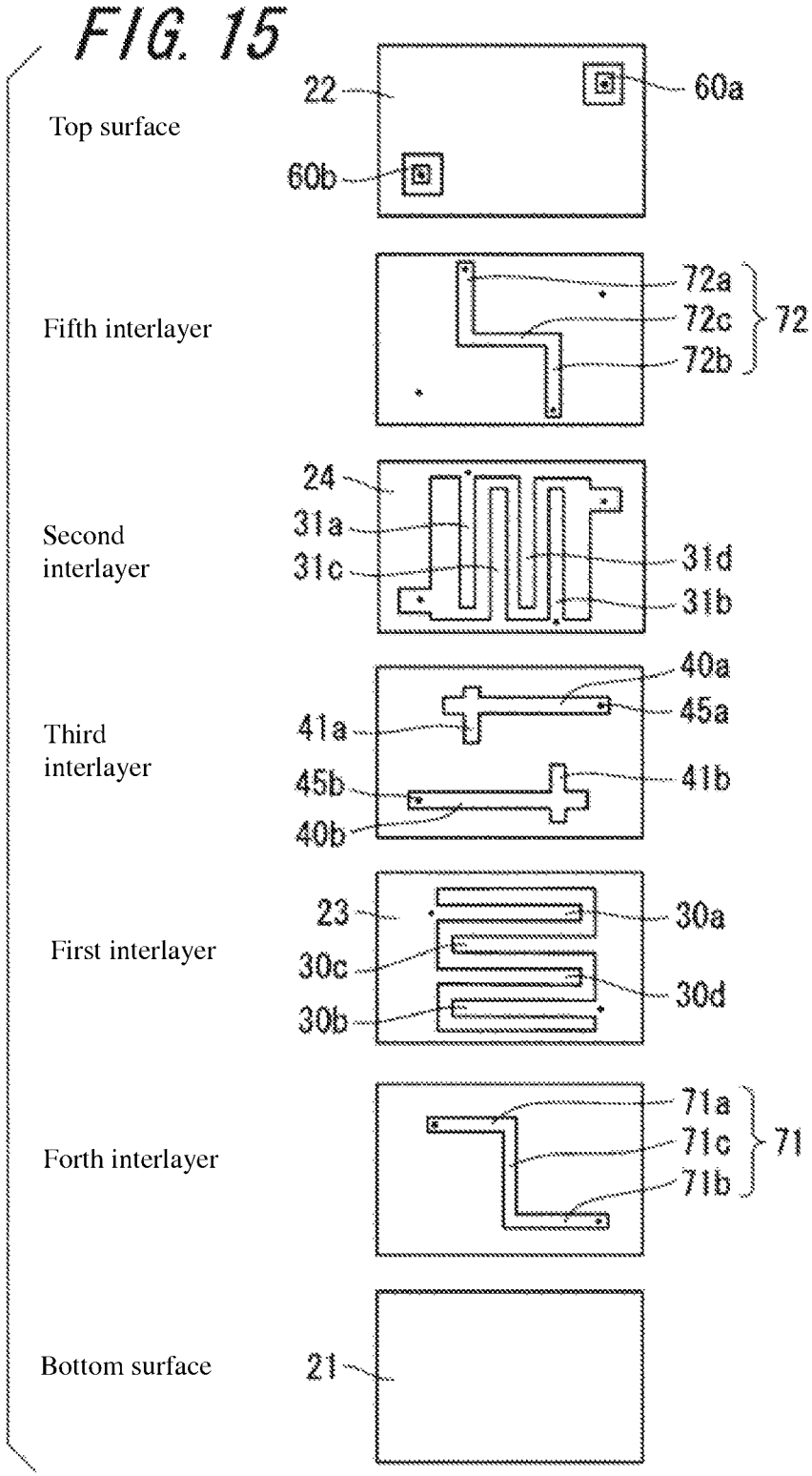
FIG. 15 is a plain view schematically showing the top and bottom surfaces and interlayer of the bandpass filter shown in FIG. 13.
Figure 16:
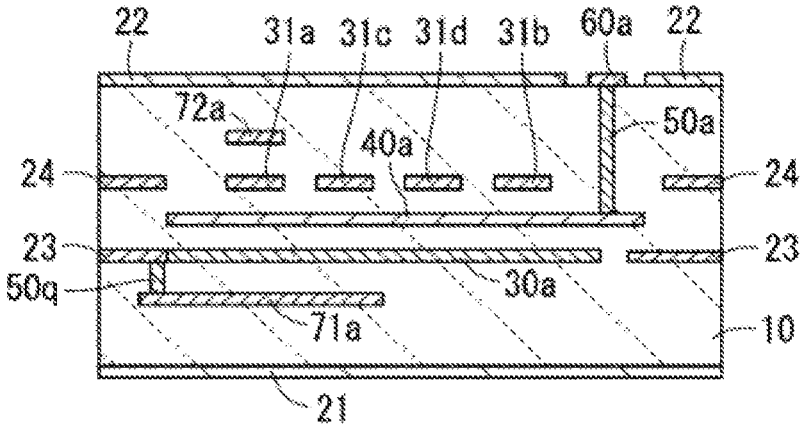
FIG. 16 is a cross-sectional view taken from the line S-S' shown in FIG. 13.

FIG. 13 is an external perspective view schematically showing the bandpass filter according to the fourth embodiment of the present invention. FIG. 14 is a schematic exploded perspective view of the bandpass filter shown in FIG. 13. FIG. 15 is a plain view schematically showing the top and bottom surfaces and interlayer of the bandpass filter shown in FIG. 13. FIG. 16 is a cross-sectional view taken from the line S-S' shown in FIG. 13. In addition, in this embodiment, only aspects different from the abovementioned first embodiment are explained so as to omit redundant explanations, and the same reference characters are used for similar components.

The bandpass filter of this embodiment, as shown in FIG. 13 to FIG. 16, comprises a first resonance electrode coupling conductor 71 and a second resonance electrode coupling conductor 72. The first resonance electrode coupling conductor 71 is disposed on a fourth interlayer located on the opposite side from the third interlayer sandwiching the first interlayer of the laminated body 10 in between. With regard to the first resonance electrode coupling conductor 71, one end thereof is grounded in the close vicinity of one end of the first resonance electrode 30*a* on the foremost stage constituting a first resonance electrode group comprising the four adjacent first resonance electrodes 30*a*, 30*b*, 30*c*, 30*d*, the other end thereof is grounded in the close vicinity of one end of the first resonance electrode 30*b* on the rearmost stage constituting the first resonance electrode group, and it has regions that are facing each of the first resonance electrode 30*a* on the foremost stage and the first resonance electrode 30*b* on the rearmost stage, respectively and electromagnetically coupled to each of the first resonance electrode. The second resonance electrode coupling conductor 72 is disposed on a fifth interlayer located on the opposite side from the third interlayer sandwiching the second interlayer of the laminated body 10 in between. With regard to the second resonance electrode coupling conductor 72, in which one end thereof is grounded in the close vicinity of one end of the second resonance electrode 31*a* on the foremost stage constituting a second resonance electrode group comprising adjacent four second resonance electrodes 31*a*, 31*b*, 31*c*, 31*d*, the other end thereof is grounded in the close vicinity of one end of the second resonance electrode 31*b* on the rearmost stage constituting a second resonance electrode group, and it has regions that are facing the one end side of the second resonance electrode 31*a* on the foremost stage and the second resonance electrode 31*b* on the rearmost stage, respectively and electromagnetically coupled to the one end side.

Furthermore, in the bandpass filter of this embodiment, the first resonance electrode coupling conductor 71 comprises a strip-shaped first preceding-stage side coupling region 71*a*, which, in parallel, faces the first resonance electrode 30*a* on the foremost stage, a strip-shaped first subsequent-stage side coupling region 71*b*, which, in parallel, faces the first resonance electrode 30*b* on the rearmost stage, and a first connection region 71*c* for connecting the first preceding-stage side coupling region 71*a* and the first subsequent-stage side coupling region 71*b* so that these regions are orthogonal to each other. The second resonance electrode coupling conductor 72 comprises a strip-shaped second preceding-stage side coupling region 72*a*, which, in parallel, faces the second resonance electrode 31*a* on the foremost stage, a strip-shaped second subsequent-stage side coupling region 72*b*, which, in parallel, faces the second resonance electrode 31*b* on the rearmost stage, and a second connection region 72*c* for connecting the second preceding-stage side coupling region 72*a* and the second subsequent-stage side coupling region 72*b* so that these regions are orthogonal to each other. However, both end portions of the first resonance electrode coupling conductor 71 are connected to the first annular ground electrode 23, respectively, via through-conductors 50*q*, 50*r*, and both end portions of the second resonance electrode coupling conductor 72 are connected to the second annular ground electrode 24 respectively via through-conductors 50*s*, 50*t*.

According to the bandpass filter of this embodiment, comprising the first resonance electrode coupling conductor 71 can cause a phenomenon between the first resonance electrode 30*a* on the foremost stage and the first resonance electrode 30*b* on the rearmost stage of the first resonance electrode group, which cancels signals transmitted by an inductive coupling via the first resonance electrode coupling conductor 71 and signals transmitted by a capacitive coupling via the adjacent first resonance electrodes, due to a 180° phase difference generated between the signals. Accordingly, in the bandpass characteristics of the bandpass filter, an attenuation pole can be formed, in which little signals are transmitted in the close vicinity of the both sides of the passband formed by the first resonance electrode.

Furthermore, according to the bandpass filter of this embodiment, comprising the second resonance electrode coupling conductor 72 can cause a phenomenon between the second resonance electrode 31*a* on the foremost stage and the second resonance electrode 31*b* on the rearmost stage of the second resonance electrode group, which cancels signals transmitted by an inductive coupling via the second resonance electrode coupling conductor 72 and signals transmitted by a capacitive coupling via the adjacent second resonance electrodes due to a 180° phase difference generated between the signals. Accordingly, an attenuation pole can be formed, in which little signals are transmitted in the close vicinity of the both sides of the passband formed by the second resonance electrode in the bandpass characteristics of the bandpass filter.

However, an even number of four or more of the resonance electrodes constituting each of the resonance electrode group are required to develop the abovementioned effects. For example, if the number of the resonance electrode constituting the resonance electrode group is an odd number, the phenomenon, which cancels the signals transmitted by an inductive coupling via the resonance electrode coupling conductor and the signals transmitted by a capacitive coupling via the adjacent resonance electrodes due to a 180° phase difference generated between the signals, is only generated at the higher frequency side than the passband of the bandpass filter, even if the inductive coupling via the resonance electrode coupling conductor is generated between the resonance electrode on the foremost stage and the resonance electrode on the rearmost stage; hence, the attenuation pole cannot be formed in the close vicinity of the both sides of the passband in the bandpass characteristics of the bandpass filter. Additionally, if the number of the resonance electrodes constituting the resonance electrode group is two, only an LC parallel resonant circuit by inductive coupling and capacitive coupling can be formed between the two resonance electrodes even if the two resonance electrodes are connected by the resonance electrode coupling conductor, and only one attenuation pole is thereby formed; hence, the attenuation pole cannot be formed in the close vicinity of the both sides of the passband.

Furthermore, according to the bandpass filter of this embodiment, the first resonance electrode coupling conductor 71 comprises a strip-shaped first preceding-stage side coupling region 71*a*, which, in parallel, faces the first resonance electrode 30*a* on the foremost stage, a strip-shaped first subsequent-stage side coupling region 71*b*, which, in parallel, faces the first resonance electrode 30*b* on the rearmost stage, and a first connection region 71*c* for connecting the first preceding-stage side coupling region 71*a* and the first subsequent-stage side coupling region 71*b* so that these regions are orthogonal to each other. Accordingly, the magnetic coupling of the first preceding-stage side coupling region 71*a* with the first resonance electrode 30*a* on the foremost stage, and the magnetic coupling of the first subsequent-stage side coupling region 71*b* with the first resonance electrode 30*b* on the rearmost stage can be strengthened respectively. Additionally, the magnetic coupling of the first resonance electrode 30*a* on the foremost stage, the first resonance electrode 30*b* on the rearmost stage, and the first resonance electrode located between them with the first connection region 71*c* can be minimized; hence, deterioration of the electrical characteristics can be minimized due to unintended electromagnetic coupling between the first resonance electrodes via the first connection region 71*c*.

Furthermore, according to the bandpass filter of this embodiment, the second resonance electrode coupling conductor 72 comprises a strip-shaped second preceding-stage side coupling region 72*a*, which, in parallel, faces the second resonance electrode 31*a* on the foremost stage, a strip-shaped second subsequent-stage side coupling region 72*b*, which, in parallel, faces the second resonance electrode 31*b* on the rearmost stage, and a second connection region 72*c* for connecting the second preceding-stage side coupling region 72*a* and the second subsequent-stage side coupling region 72*b* so that these regions are orthogonal to each other. Accordingly, the magnetic coupling of the second preceding-stage side coupling region 72*a* with the second resonance electrode 31*a* on the foremost stage and the magnetic coupling of the second subsequent-stage side coupling region 72*b* with the second resonance electrode 31*b* on the rearmost stage can be strengthened respectively. Additionally, the magnetic coupling of the second resonance electrode 31*a* on the foremost stage, the second resonance electrode 31*b* on the rearmost stage, and the second resonance electrode located between them with the second connection region 72*c* can be minimized; hence, deterioration of the electrical characteristics can be minimized due to unintended electromagnetic coupling between the second resonance electrodes via the second connection region 72*c*.

Furthermore, according to the bandpass filter of this embodiment, with regard to the first resonance electrode coupling conductor 71, one end thereof is connected to the first annular ground electrode 23 in the close vicinity of one end of the first resonance electrode 30*a* on the foremost stage constituting the first resonance electrode group via the through-conductor 50*q*, and the other end thereof is connected to the first annular ground electrode 23 in the close vicinity of one end of the first resonance electrode 30*b* on the rearmost stage constituting the first resonance electrode group via the through-conductor 50*r*. Therefore, compared to the case in which the both sides of the first resonance electrode coupling conductor 71 are connected to the first ground electrode 21 or the second ground electrode 22 and thus grounded, the electromagnetic coupling of the first resonance electrode 30*a* on the foremost stage constituting the first resonance electrode group with the first resonance electrode 30*b* on the rearmost stage constituting the first resonance electrode group via the first resonance electrode coupling conductor 71 can be further strengthened; hence, the attenuation pole formed on both sides of the passband formed by the first resonance electrodes 30*a*, 30*b*, 30*c*, 30*d* can be further moved in the closer vicinity of the passband. Accordingly, attenuation in an inhibition zone in the vicinity of the passband can be further increased.

Similarly, according to the bandpass filter of this embodiment, with regard to the second resonance electrode coupling conductor 72, one end thereof is connected to the second annular ground electrode 24 in the close vicinity of one end of the second resonance electrode 31*a* on the foremost stage constituting the second resonance electrode group via the through-conductor 50*s*, and the other end thereof is connected to the second annular ground electrode 24 in the close vicinity of one end of the second resonance electrode 31*b* on the rearmost stage constituting the second resonance electrode group via the through-conductor 50*t*. Therefore, compared to the case in which the both sides of the second resonance electrode coupling conductor 72 are connected to the first ground electrode 21 or to the second ground electrode 22 and thus grounded, the electromagnetic coupling of the second resonance electrode 31*a* on the foremost stage constituting the second resonance electrode group with the second resonance electrode 31*b* on the rearmost stage constituting the second resonance electrode group, via the second resonance electrode coupling conductor 72, can be further strengthened; hence, the attenuation pole formed on the both sides of the passband formed by the second resonance electrodes 31*a*, 31*b*, 31*c*, 31*d* can be further moved in the closer vicinity of the passband. Accordingly, attenuation in an inhibition zone in the close vicinity of the passband can be further increased.

Fifth Embodiment

Figure 17:
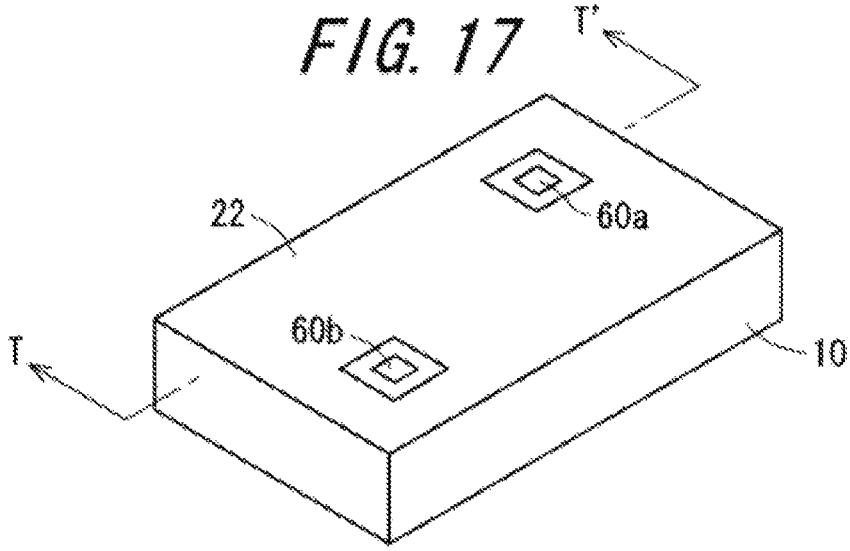
FIG. 17 is an external perspective view schematically showing the bandpass filter according to the fifth embodiment of the present invention.
Figure 18:
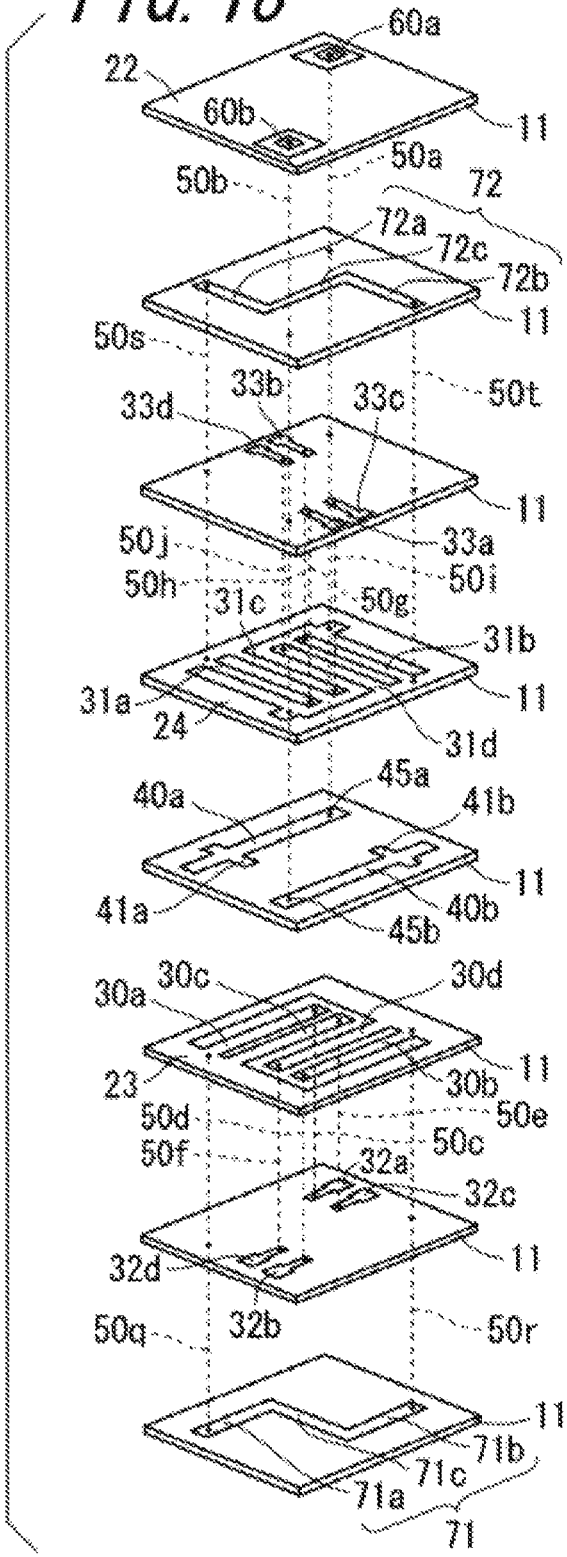
FIG. 18 is a schematic exploded perspective view of the bandpass filter shown in FIG. 17.
Figure 19:
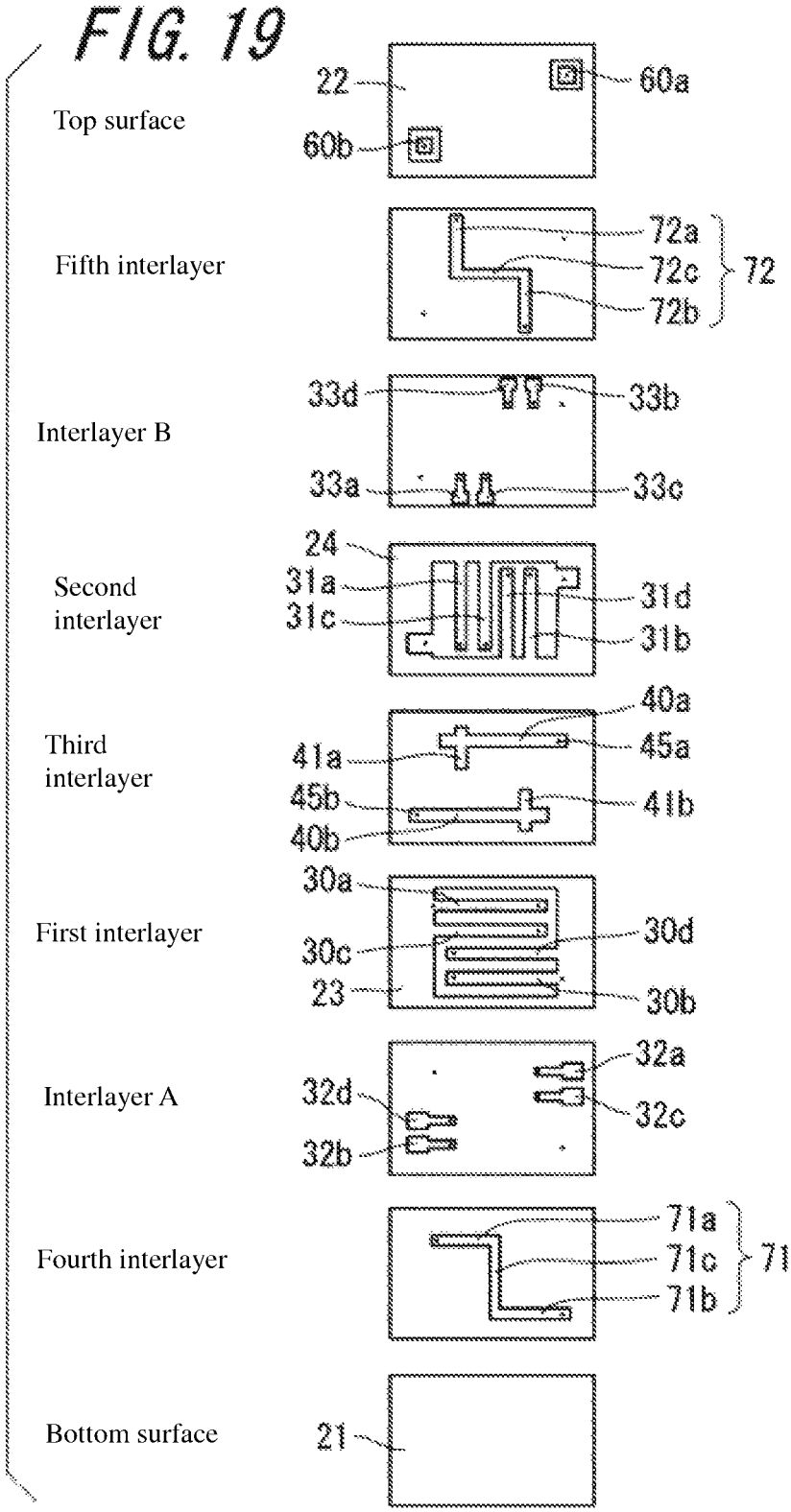
FIG. 19 is a plain view schematically showing the top and bottom surfaces and interlayer of the bandpass filter shown in FIG. 17.
Figure 20:
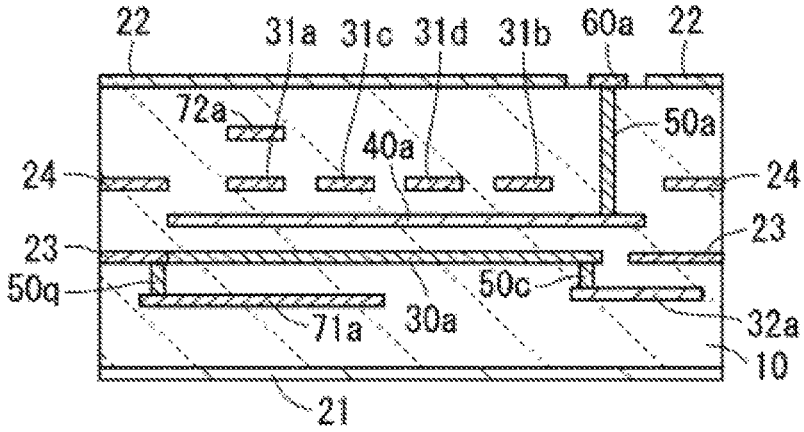
FIG. 20 is a cross-sectional view taken from the line T-T' shown in FIG. 17.

FIG. 17 is an external perspective view schematically showing the bandpass filter according to the fifth embodiment of the present invention. FIG. 18 is a schematic exploded perspective view of the bandpass filter shown in FIG. 17. FIG. 19 is a plain view schematically showing the top and bottom surfaces and interlayer of the bandpass filter shown in FIG. 17. FIG. 20 is a cross-sectional view taken from the line T-T' of the bandpass filter shown in FIG. 17. In addition, in this embodiment, only aspects different from the abovementioned forth embodiment are explained so as to omit redundant explanations, and the same reference characters are used for similar components. In the bandpass filter of this present invention, as shown in FIG. 17 to FIG. 20, the first resonance electrodes 30*a*, 30*c* are electromagnetically coupled to each other in a comb-line form, the first resonance electrodes 30*b*,

30*d* are electromagnetically coupled to each other in a comb-line form, the second resonance electrodes 31*a*, 31*c* are electromagnetically coupled to each other in a comb-line form, and the second resonance electrodes 31*b*, 31*d* are electromagnetically coupled to each other in a comb-line form. However, the first resonance electrodes 30*c*, 30*d* are electromagnetically coupled to each other in an inter-digital form, and the second resonance electrodes 31*c*, 31*d* are electromagnetically coupled to each other in an inter-digital form.

Even in the bandpass filter comprising such a configuration, a bandpass filter comprising excellent bandpass characteristics, in which attenuation varies rapidly form the bandpass to the inhibition zone by providing an attenuation pole on both sides of each of two passbands, can be obtained. Although the mechanism in this configuration has not yet been defined completely, the reason for this is considered attributable to the notion that the first resonance electrodes 30*a*, 30*b*, 30*c*, 30*d* constituting the first resonance electrode group are capacitively-coupled as a whole, and the second resonance electrodes 31*a*, 31*b*, 31*c*, 31*d* constituting the second resonance electrode group are capacitively-coupled as a whole.

Additionally, in the bandpass filter of this embodiment, the first resonance auxiliary electrodes 32*a*, 32*b*, 32*c*, 32*d* are disposed on the interlayer A located between the first interlayer and the fourth interlayer of the laminated body 10, and are connected to the other end side of the first resonance electrodes 30*a*, 30*b*, 30*c*, 30*d* via the through-conductors 50*c*, 50*d*, 50*e*, 50*f*, respectively. Additionally, the second resonance auxiliary electrodes 33*a*, 33*b*, 33*c*, 33*d* are disposed on the interlayer B located between the second interlayer and the fifth interlayer of the laminated body 10, and are connected to the other end side of the second resonance electrodes 31*a*, 31*b*, 31*c*, 31*d* via the through-conductors 50*g*, 50*h*, 50*i*, 50*j*, respectively.

Sixth Embodiment

Figure 21:
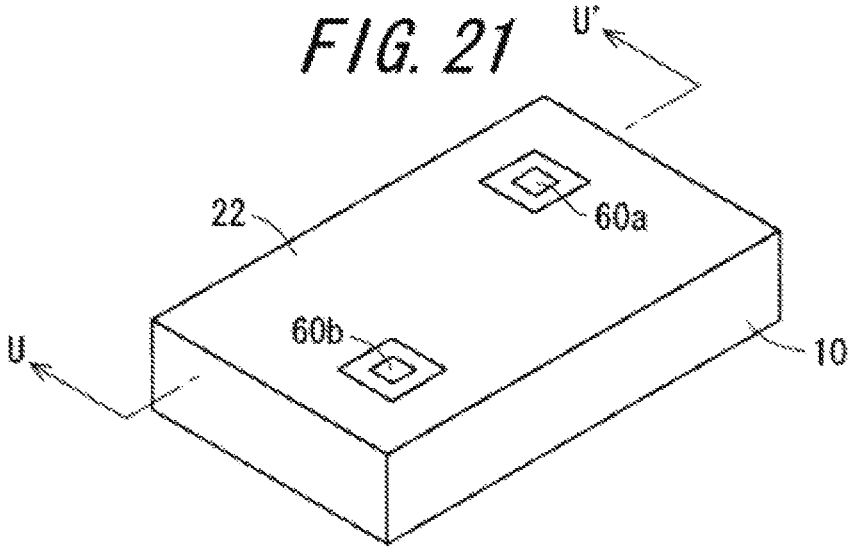
FIG. 21 is an external perspective view schematically showing the bandpass filter according to the sixth embodiment of the present invention.
Figure 22:
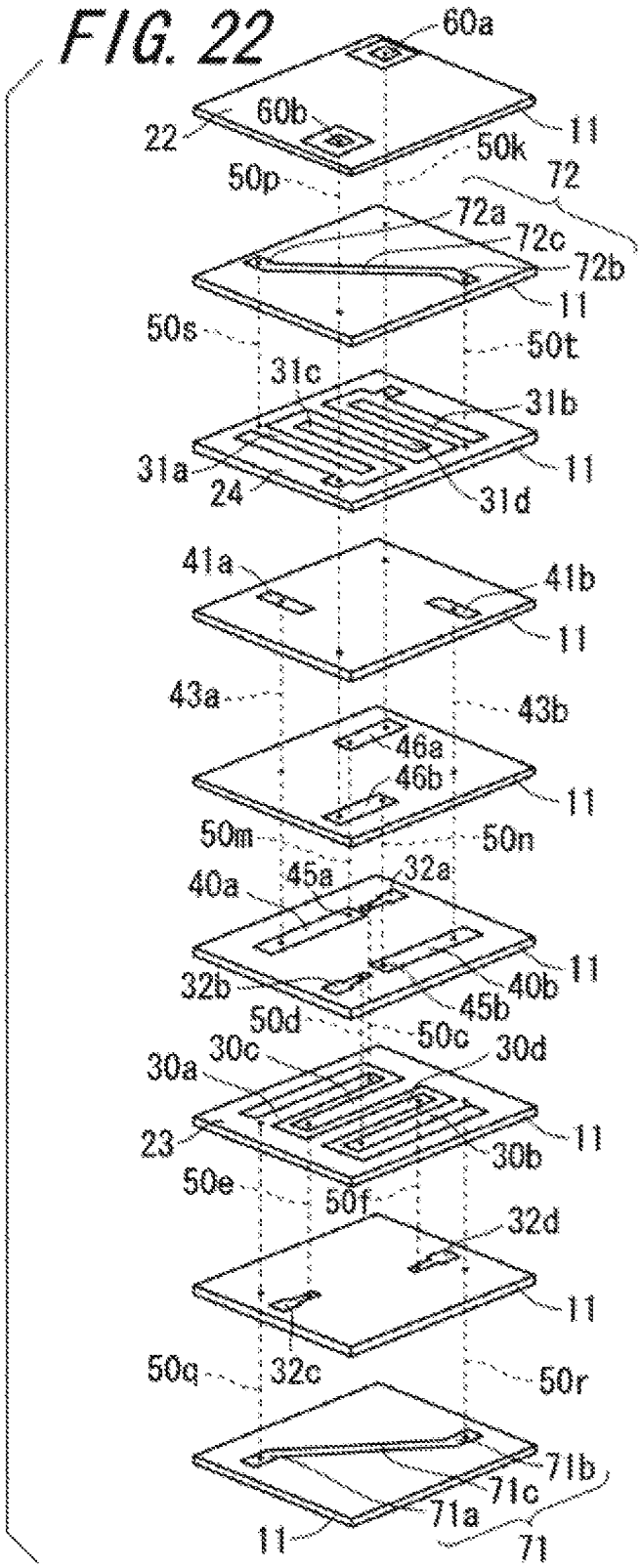
FIG. 22 is a schematic exploded perspective view of the bandpass filter shown in FIG. 21.
Figure 23:
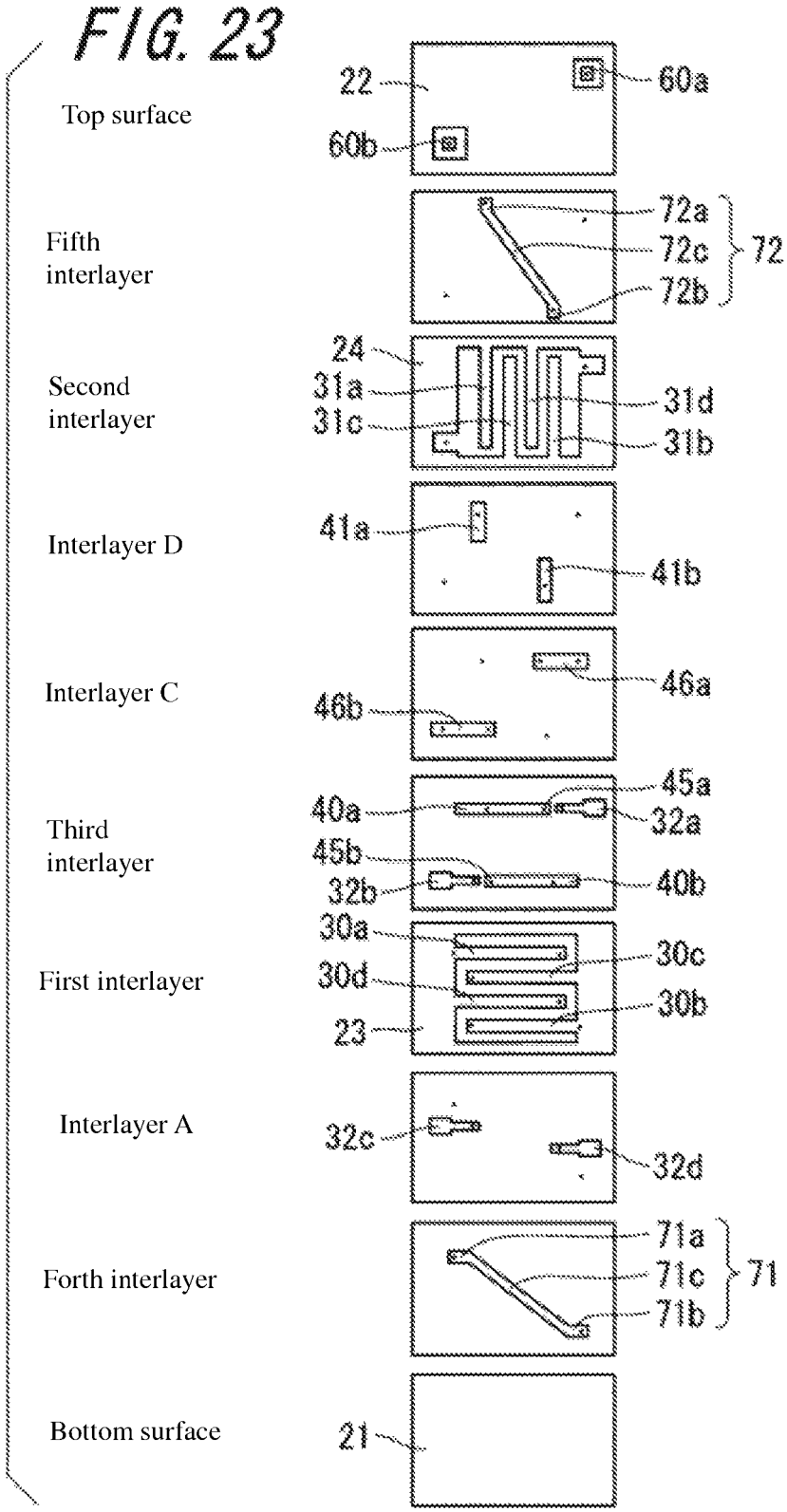
FIG. 23 is a plain view schematically showing the top and bottom surfaces and interlayer of the bandpass filter shown in FIG. 21.
Figure 24:
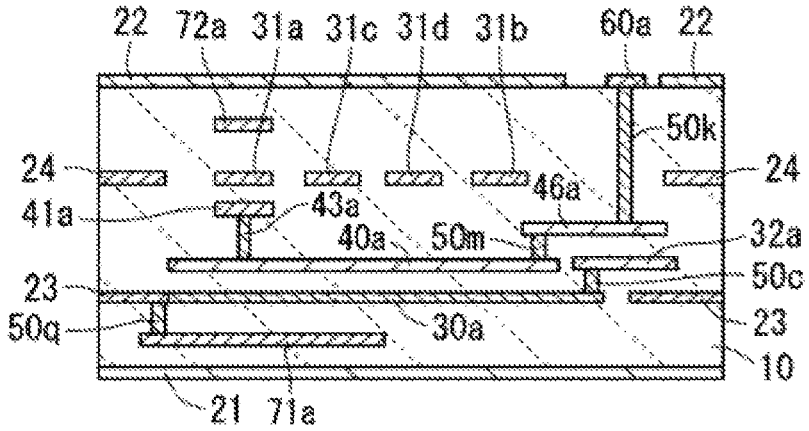
FIG. 24 is a cross-sectional view taken from the line U-U' shown in FIG. 21.

FIG. 21 is an external perspective view schematically showing the bandpass filter according to the sixth embodiment of the present invention. FIG. 22 is a schematic exploded perspective view of the bandpass filter shown in FIG. 21. FIG. 23 is a plain view schematically showing the top and bottom surfaces and interlayer of the bandpass filter shown in FIG. 21. FIG. 24 is a cross-sectional view taken from the line U-U' of the bandpass filter shown in FIG. 21. In addition, in this embodiment, only aspects different from the abovementioned fourth embodiment are explained so as to omit redundant explanations, and the same reference characters are used for similar components.

In the bandpass filter of this embodiment, as shown in FIG. 21 to FIG. 24, the first resonance auxiliary electrodes 32*c*, 32*d* are disposed on the interlayer A located between the first interlayer and the fourth interlayer of the laminated body 10, and are connected to the other end side of the first resonance electrodes 30*c*, 30*d* via the through-conductors 50*e*, 50*f*, respectively. Additionally, the first resonance auxiliary electrodes 32*a*, 32*b* are disposed on the third interlayer of the laminated body 10, and connected to the other end side of the first resonance electrodes 30*a*, 30*b* via the through-conductors 50*c*, 50*d* that penetrate, respectively.

Additionally, the bandpass filter of this embodiment comprises the input coupling auxiliary electrode 46*a* and the output coupling auxiliary electrode 46*b*. The input coupling auxiliary electrode 46*a* is disposed on the interlayer C located between the second interlayer and the third interlayer, in which a region facing the first input coupling electrode 40*a* is connected to the first input coupling electrode 40*a* via the through-conductor 50*m*, and a region facing the first resonance auxiliary electrode 32*a* is connected to the input terminal electrode 60*a* via the through-conductor 50*k*. The output coupling auxiliary electrode 46*b* is disposed on the interlayer C, in which a region facing the first output coupling electrode 40*b* is connected to the first output coupling electrode 40*b* via the through-conductor 50*n*, and a region facing the first resonance auxiliary electrode 32*b* is connected to the output terminal electrode 60*b* via the through-conductor 50*p*.

Furthermore, in the bandpass filter of this embodiment, the second input coupling electrode 41*a* and the second output coupling electrode 41*b* are connected to the interlayer D located between the second interlayer and the interlayer C, the second input coupling electrode 41*a* is connected to the first input coupling electrode 40*a* via the input side connecting conductor 43*a*, and the second output coupling electrode 41*b* is connected to the first output coupling electrode 40*b* via the output side connecting conductor 43*b*.

Furthermore, in the bandpass filter of this embodiment, the first connection region 71*c* of the first resonance electrode coupling conductor 71 is disposed so as to obliquely-intersect with the first preceding-stage side coupling region 71*a* and the first subsequent-stage side coupling region 71*b*, and the second connection region 72*c* of the second resonance electrode coupling conductor 72 is disposed so as to obliquely-intersect with the second preceding-stage side coupling region 72*a* and the second subsequent-stage side coupling region 72*b*.

Even in the bandpass filter comprising such a configuration, a bandpass filter comprising excellent bandpass characteristics, in which attenuation varies rapidly form the bandpass to the inhibition zone by providing an attenuation pole on both sides of each of two passbands, can be obtained.

Seventh Embodiment

Figure 25:
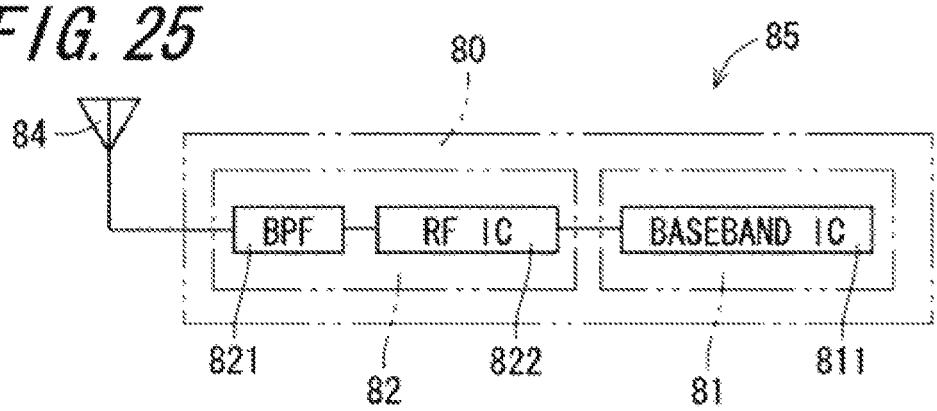
FIG. 25 is a block diagram showing a constitutional example of a wireless communication module and a wireless communication device according to the seventh embodiment of the present invention.

FIG. 25 is a block diagram showing a constitutional example of a wireless communication module 80 and a wireless communication device 85 according to the seventh embodiment of the present invention.

The wireless communication module 80 of this invention comprises, for example, a baseband portion 81, in which baseband signals are processed, and an RF portion 82, in which it is connected to the baseband portion 81 and in which baseband signals after modulation and RF signals before demodulation are processed. The RF portion 82 includes a bandpass filter 821 of any of the abovementioned first to sixth embodiments of the present invention, wherein RF signals that are made from modulated baseband signals or signals at communication bands other than the received RF signals are attenuated via the bandpass filter 821. As a specific configuration, on the baseband portion 81, a baseband IC 811 is disposed, and on the RF portion 82, an RF IC 822 is disposed between the bandpass filter 821 and the baseband portion 81. In addition, another circuit may be interposed between these circuits. In turn, an antenna 84 is connected to the bandpass filter 821 of the wireless communication module 80, thus configuring a wireless communication device 85 of this embodiment to send and receive RF signals.

According to the wireless communication module 80 and the wireless communication device 85 of this embodiment comprising such a configuration, by using the bandpass filter 821 of any of the first to the third embodiments of the present invention with small signal loss, in which input impedance is well matched and passed across the entire frequency band used for communication, for filtering waves of sent signals and received signals, attenuation of sent signals and received signals that pass the bandpass filter 821 diminishes; hence, the reception sensitivity increases, and in addition, the amplification of sent signals and received signals can be small, resulting in less power consumption in the amplifier circuit. Therefore, an enhanced wireless communication module 80 and wireless communication device 85 with high receiving sensitivity and low power consumption can be obtained.

Additionally, according to the wireless communication module 80 and the wireless communication device 85 of this embodiment, by using the bandpass filter 821 of any of the fourth to the sixth embodiments of the present invention with small signal loss, in which input impedance is well matched and passed across the entire frequency band used for communication and in which attenuation in an inhibit zone is sufficiently secured by the attenuation pole formed in the close vicinity of a passband, for filtering waves of sent signals and received signals, attenuation of sent signals and received signals that pass the bandpass filter 821 becomes less; hence, the reception sensitivity is increased, and in addition, the amplification of sent signals and received signals can be small, resulting in less power consumption in the amplifier circuit. Therefore, an enhanced wireless communication module 80 and wireless communication device 85 with high receiving sensitivity and low power consumption can be obtained.

In the abovementioned bandpass filter of the first to the sixth embodiments, as the material for the dielectric layer 11, for example, resins such as epoxy, or ceramics such as dielectric ceramics may be used. For example, glass-ceramic materials that comprise dielectric ceramics materials such as $BaTiO_3$, $Pb_4Fe_2Nb_2O_{12}$, $TiO_2$ and glass materials such as $B_2O_3$, $SiO_2$, $Al_2O_3$, ZnO and that can be fired at relatively lower temperatures of approximately 800 to 1,200° C. are preferably used. Additionally, the thickness of the dielectric layer 11 is set to be approximately 0.01 to 0.1 mm, for example.

As the materials for the abovementioned various types of electrodes and through-conductors, for example, conductive materials composed mostly of Ag alloys such as Ag, Ag—Pd, Ag—Pt or Cu, W, Mo, Pd-based conductive materials are preferably used. The thickness of various types of electrodes is set to be 0.001 to 0.2 mm, for example.

The abovementioned bandpass filter of the first to the sixth embodiments can be manufactured as follows, for example. First, slurries are made by adding and mixing an appropriate organic solvent, etc. into ceramic raw powder, and at the same time, a ceramic green sheet is formed by using the doctor blade method. Subsequently, through-holes to form through-conductors are created on the obtained ceramic green sheet by using a punching machine, etc., filled with conductor paste containing conductors such as Ag, Ag—Pd, Au, or Cu, and ceramic green sheets with conductor paste are created on the surface of the ceramic green sheet by applying the same conductor paste as the above by using the printing method. Then, these ceramic green sheets with conductor paste are laminated, compressed by using a hot pressing device, and fired at a peak temperature of approximately 800° C. to 1,050° C.

(Variations)

The present invention is not limited to the abovementioned first to seventh embodiments; however, a variety of changes and modification may be made without deviating from the scope of the present invention.

For example, in the abovementioned first to sixth embodiments, while examples of comprising the input terminal electrode 60*a* and the input terminal electrode 60*b* are shown, if the bandpass filter is formed within a region of a module substrate, the input terminal electrode 60*a* and the output terminal electrode 60*b* are not always necessary, and a wiring conductor from the external circuit within the substrate may be directly connected to the first input coupling electrode 40*a* and the first output coupling electrode 40*b*. In this case, the connection points of the first output coupling electrode 40*a* and the second output coupling electrode 40*b* with the wiring conductor are the electrical signal output point 45*a* of the first electrical coupling electrode 40*a* and the electrical signal output point 45*b* of the first output coupling electrode 40*b*. Additionally, if the input coupling auxiliary electrode 46*a* and the output coupling auxiliary electrode 46*b* are provided, a wiring conductor within the module substrate from the external circuit may be directly connected to the input coupling auxiliary electrode 46*a* and the output coupling auxiliary electrode 46*b*.

Furthermore, in the abovementioned first to sixth embodiments, while examples in which the first ground electrode 21 is disposed on the bottom surface of the laminated body 10 and in which the second ground electrode 22 is disposed on the top surface of the laminated body 10, are shown, for example, the dielectric layers may be further disposed under the first ground electrode 21, and the dielectric layers may be further disposed above the second ground electrode 22.

Furthermore, in the abovementioned first to third embodiments, while examples comprising four first resonance electrodes 30*a*, 30*b*, 30*c*, 30*d* and four second resonance electrodes 31*a*, 31*b*, 31*c*, 31*d* are shown, the number of first resonance electrodes and second resonance electrodes may be changed depending on the necessary passband width and attenuation outside the passband. In cases in which the necessary passband width is narrow or the necessary attenuation outside of the passband is small, etc., the number of resonance electrodes may be reduced, and in contrast, in cases in which the necessary passband width is wide or the necessary attenuation outside of the passband is large, etc., the number of resonance electrodes may be further increased. However, if the number of resonance electrodes increases excessively, the size becomes large and loss within the passband increases; therefore, it is desirable that the number of first resonance electrodes and second resonance electrodes be set to be approximately 10 or fewer, respectively.

Furthermore, in the abovementioned fourth to sixth embodiments, while examples comprising four first resonance electrodes 30*a*, 30*b*, 30*c*, 30*d* and four second resonance electrodes 31*a*, 31*b*, 31*c*, 31*d* and in which the first resonance electrode group and the second resonance electrode group are comprising four resonance electrodes, respectively, are shown, the number of the first resonance electrode and the second resonance electrode, and the number of the resonance electrodes constituting the first resonance electrode group and the second resonance electrode group can be set freely as long as it is within a range in which the first resonance electrode group and the second resonance group are constituted with an even number of four or more of the resonance electrodes. For example, there may be six first resonance electrodes so that the first resonance electrode group is constituted of that six. Additionally, there may be six first resonance electrodes so that the first resonance electrode group is constituted of any four adjacent resonance electrodes among them. It is similar for the second resonance electrode as well. However, if the number of resonance electrodes increases excessively, the size becomes large and loss within the passband increases; therefore, it is desirable that the number of first resonance electrodes and second resonance electrodes be set to be approximately 10 or fewer, respectively.

Furthermore, in the abovementioned first to sixth embodiments, while examples in which the number of the first resonance electrode is equal to the number of the second resonance electrode, the number of the first resonance electrode and the number of the second resonance electrode may be different.

Furthermore, in the abovementioned first, third, fourth, and sixth embodiments, examples, in which, in both of the first resonance electrodes 30*a*, 30*b*, 30*c*, 30*d* and the second resonance electrodes 31*a*, 31*b*, 31*c*, 31*d*, one ends (ground end) of the resonance electrodes are disposed side by side so as to alternate each other and electromagnetically coupled in an inter-digital form, respectively, are shown, and, in the abovementioned second and fifth embodiments, examples, in which, in both of the first resonance electrodes 30*a*, 30*b*, 30*c*, 30*d* and the second resonance electrodes 31*a*, 31*b*, 31*c*, 31*d*, a comb-line form electromagnetic coupling in which one ends of adjacent electrodes are disposed so that they are located on the same side, and an inter-digital form electromagnetic coupling in which one ends of adjacent electrodes are disposed so as to alternate each other coexist, are shown; however, if it is not necessary to be in symmetrical structure, all of the resonance electrodes of at least one of the first resonance electrodes 30*a*, 30*b*, 30*c*, 30*d* and the second resonance electrodes 31*a*, 31*b*, 31*c*, 31*d* may be electromagnetically coupled in a comb-line form. Additionally, the first resonance electrodes 30*a*, 30*b*, 30*c*, 30*d* and the second resonance electrode 31*a*, 31*b*, 31*c*, 31*d* may be disposed so as to be in a different combined state. However, the coupling of each of the resonators on the foremost stage and the resonators on the rearmost stage of each of the first resonance electrode group and the second resonance electrode group, via adjacent resonance electrodes, is considered necessary to be a capacitive coupling in whole.

Furthermore, in the abovementioned fourth to sixth embodiments, while examples comprising both of the first resonance electrode coupling conductor 71 and the second resonance electrode coupling conductor 72 are shown, it may comprise one of the first resonance electrode coupling conductor 71 or the second resonance electrode coupling conductor 72.

Furthermore, in the abovementioned fourth to sixth embodiments, while an example in which both sides of the first resonance electrode coupling conductor 71 are connected to the first annular ground electrode 23 in the close vicinity of one ends of the first resonance electrode on the foremost stage and the first resonance electrode on the rearmost stage constituting the first resonance electrode group via the through-conductors 50*q*, 50*r*, and in which both sides of the second resonance electrode coupling conductor 72 are connected to the second annular ground electrode 24 in the close vicinity of one ends of the second resonance electrode on the foremost stage and the second resonance electrode on the rearmost stage constituting the second electrode group via the through-conductors 50*s*, 50*t*, is shown; however, for example, both sides of the first resonance electrode coupling conductor 71 may be connected to the first ground electrode 21 via the through-conductors 50*q*, 50*r*, and both sides of the second resonance electrode coupling conductor 72 may be connected to the second ground electrode 22 via the through-conductors 50*s*, 50*t*. Additionally, for example, an annular ground conductor may be disposed around the circumference of the first resonance electrode coupling conductor 71 and the second resonance electrode coupling conductor 72 so as to connect both sides of the first resonance electrode coupling conductor 71 and the second resonance electrode coupling conductor 72 thereto. However, if it is intended to move an attenuation pole generated on both sides of a passband in the closer vicinity of the passband, these methods are less favorable. Furthermore, in the abovementioned first to sixth embodiments, while an example, in which the laminated body 10 is constituted of one laminated body, is shown, the laminated body 10 may be constituted of a plurality of laminated bodies disposed by being piled up in the direction of lamination of each of the laminated body. For example, in the abovementioned bandpass filter of the first embodiment, while the laminated body 10 is constituted of a first laminated body and a second laminated body disposed thereon, the first interlayer may be an interlayer in the first laminated body, the second interlayer may be an interlayer in the second laminated body disposed on the first laminated body, and the third interlayer may be an interlayer between the first laminated body and the second laminated body. Additionally, in the abovementioned bandpass filter of the fourth embodiment, while the laminated body 10 is constituted of a first laminated body and a second laminated body disposed thereon, the first interlayer and the fourth interlayer may be an interlayer in the first laminated body, the second interlayer and the fifth interlayer are an interlayer in the second laminated body disposed on the first interlayer, and the third interlayer may be an interlayer between the first laminated body and the second laminated body.

Furthermore, while the explanation has been made based on examples of bandpass filters used for UWB, needless to say, the bandpass filter of this embodiment is also useful in other applications requiring broadband.

EXAMPLES

The specific examples of the bandpass filter of this embodiment are described below.

Example 1

The electrical characteristics of the bandpass filter of the third embodiment shown in FIG. 9 to FIG. 12 are computed through a simulation using a finite element method.

As the computation condition, the plurality of first resonance electrodes 30*a*, 30*b*, 30*c*, 30*d* are made into a rectangular that is 0.175 mm in width, the first resonance electrodes 30*a*, 30*b* are made to be 3.4 mm in length, and the first resonance electrodes 30*c*, 30*d* are made to be 3.5 mm in length. The interval between the first resonance electrode 30*a* and the first resonance electrode 30*c*, and the interval between the first resonance electrode 30*d* and the first resonance electrode 30*b* are made to be 0.08 mm, respectively, and the interval between the first resonance electrode 30*c* and the first resonance electrode 30*d* is made to be 0.095 mm.

The plurality of second resonance electrodes 31*a*, 31*b*, 31*c*, 31*d* are made into a rectangular that is 0.175 mm in width, the second resonance electrodes 31*a*, 31*b* are made to be 2.87 mm in length, and the second resonance electrode 31*c*, 31*d* are made to be 2.93 mm in length. The interval between the second resonance electrode 31*a* and the second resonance electrode 31*c*, and the interval between the second resonance electrode 31*d* and the second resonance electrode 31*b* are made to be 0.075 mm respectively, and the interval between the second resonance electrode 31*c* and the second resonance electrode 31*d* is made to be 0.11 mm.

The first resonance auxiliary electrodes 32*a*, 32*b* are made to be a shape, respectively, joining a rectangular that is disposed 0.3-mm away from the other end of the first resonance electrodes 30*a*, 30*b* and made to be 0.28 mm in width and 0.31 mm in length, with a rectangular that is directed toward the first resonance electrodes 30*a*, 30*b* and made to be 0.2 mm in width and 0.5 mm in length. The first resonance auxiliary electrodes 32*c*, 32*d* are made to be a shape, respectively, joining a rectangular that is disposed 0.2-mm away from the other end of the first resonance electrodes 30*c*, 30*d* and made to be 0.35 mm in width and 0.39 mm in length, with a rectangular that is directed toward the first resonance electrodes 30*c*, 30*d* and made to be 0.2 mm in width and 0.5 mm in length.

The first input coupling electrode 40*a* and the first output coupling electrode 40*b* are made into a rectangular that is 0.15 mm in width and 2.1 mm in length. The second input coupling conductor 41*a* is made into a rectangular that is 0.175 mm in width and 1.735 mm in length, and connected via the input side connection conductor 43*a* at a position of 0.77 mm from the center of the portion facing the first resonance electrode 30*a* of the first input coupling electrode 40*a* toward an opposite side of the electrical signal input point 45*a*. The second output coupling conductor 41*b* is made into a rectangular that is 0.175 mm in width and 1.735 mm in length, and connected via the output side connection conductor 43*b* at a position of 0.77 mm from the center of the portion facing the first resonance electrode 30*b* of the first output coupling electrode 40*b* toward an opposite side of the electrical signal output point 45*b*. The input coupling auxiliary electrode 46*a* and the output coupling auxiliary electrode 46*b* are made into a rectangular that is 0.15 mm in width and 1.25 mm in length.

The input terminal electrode 60*a* and the output terminal electrode 60*b* are made into a square that are 0.2 mm on each side. The shapes of the first ground electrode 21, the second ground electrode 22, the first annular ground electrode 23, and the second annular ground electrode 24 are made into a rectangular that are 3.8 mm in width and 5 mm in length, the opening of the first annular ground electrode 23 is made into a rectangular that is 3.1 mm in width and 3.65 mm in length, and the opening of the second annular ground electrode 24 is made into a rectangular that is 3.1 mm in width and 3.79 mm in length.

The entire shape of the bandpass filter is made into a rectangular parallelepiped shape that is 3.8 mm in width, 5 mm in length, and 0.51 mm in thickness. The interval between the bottom surface and the interlayer A of the laminated body 10 is made to be 0.115 mm, the interval between the interlayer A and the first interlayer and the interval between the first interlayer and the third interlayer are made to be 0.015 mm, the interval between the third interlayer and the interlayer C is made to be 0.04 mm, the interval between the interlayer C and the interlayer D is made to be 0.065 mm, the interval between the interlayer D and the second interlayer is made to be 0.04 mm, and the interval between the second interlayer and the top surface of the laminated body 10 is made to be 0.14 mm. The thickness of each electrode is made to be 0.01 mm, and the diameter of the input side connection conductor 43*a*, the output side connection conductor 43*b*, and the through-conductor 50 is made to be 0.1 mm. The relative permittivity of the dielectric layer 11 is made to be 7.5.

Figure 26:
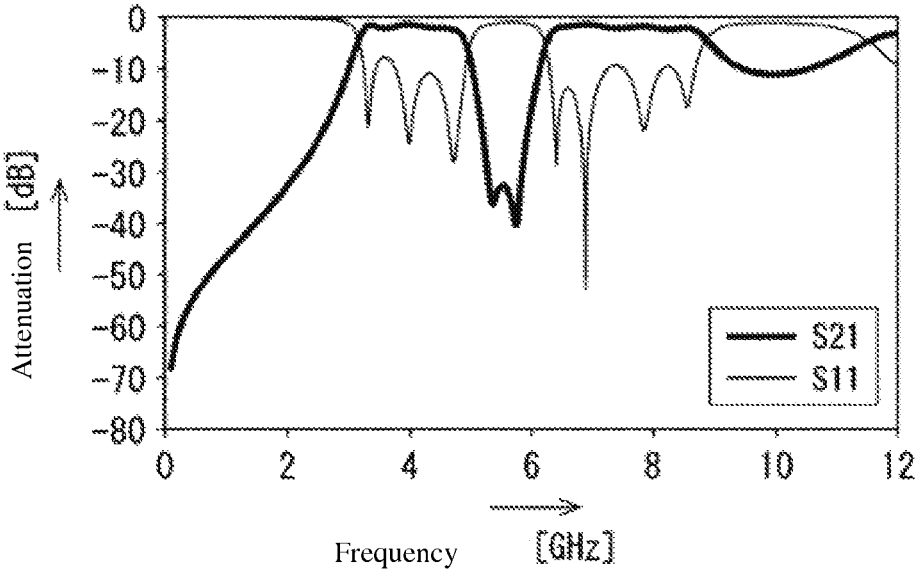
FIG. 26 is a diagram showing simulation results of electrical characteristics of the bandpass filter according to the Example 1.

FIG. 26 is a graph showing the simulation result in which the horizontal axis indicates frequency and the vertical axis indicates attenuation, showing the bandpass characteristics (S21) and reflectance characteristics (S11) of the bandpass filter. According to the graph shown in FIG. 26, although the thickness of the laminated body 10 is very thin, being 0.51 mm, excellent bandpass characteristics that is flat and low-loss, in which impedance is well matched, can be obtained across the two substantially wide passbands. Based on this result, according to the bandpass filter of Example 1, even if it has a very thin shape, excellent bandpass characteristics, in which it is flat and low-loss across the two wide passbands, can be obtained, and the effectiveness of the present invention was observed.

Example 2

The electrical characteristics of the bandpass filter of the sixth embodiment shown in FIG. 21 to FIG. 24 are computed through a simulation using a finite element method.

As the computation condition, the plurality of first resonance electrodes 30*a*, 30*b*, 30*c*, 30*d* are made into a rectangular that is 0.175 mm in width, the first resonance electrodes 30*a*, 30*b* are made to be 3.4 mm in length, and the first resonance electrodes 30*c*, 30*d* are made to be 3.5 mm in length. The interval between the first electrodes 30*a* and 30*c* and the interval between the first resonance electrodes 30*d* and 30*b* are made to be 0.06 mm, respectively, and the interval between the first resonance electrode 30*c* and 30*d* is made to be 0.055 mm.

The plurality of second resonance electrodes 31*a*, 31*b*, 31*c*, 31*d* are made into a rectangular that is 0.175 mm in width, the second resonance electrodes 31*a*, 31*b* are made to be 2.67 mm in length, and the second resonance electrode 31*c*, 31*d* are made to be 3.175 mm in length. The interval between the second resonance electrode 31*a* and 31*c* and the interval between the second resonance electrode 31*d* and 31*b* are made to be 0.07 mm, respectively, and the interval between the second resonance electrode 31*c* and 31*d* is made to be 0.105 mm.

The first resonance auxiliary electrodes 32*a*, 32*b* are made to be a shape, respectively, joining a rectangular that is disposed 0.3-mm away from the other end of the first resonance electrodes 30*a*, 30*b*, and made to be 0.3 mm in width and 0.43 mm in length, with a rectangular that is directed toward the first resonance electrodes 30*a*, 30*b*, and made to be 0.2 mm in width and 0.5 mm in length. The first resonance auxiliary electrodes 32*c*, 32*d* are made to be a shape, respectively, joining a rectangular that is disposed 0.2-mm away from the other end of the first resonance electrodes 30*c*, 30*d*, and made to be 0.35 mm in width and 0.48 mm in length, with a rectangular that is directed toward the first resonance electrodes 30*c*, 30*d*, and made to be 0.2 mm in width and 0.5 mm in length.

The first input coupling electrode 40*a* and the first output coupling electrode 40*b* are made into a rectangular that is 0.15 mm in width and 3.5 mm in length. The input coupling auxiliary electrode 46*a* and the output coupling auxiliary electrode 46*b* are made into a rectangular that is 0.15 mm in width and 1.25 mm in length. The second input coupling conductor 41*a* is made into a rectangular that is 0.175 mm in width and 1.785 mm in length, and connected via the input side connection conductor 43*a* at a position of 0.11 mm from the center of the portion facing the first resonance electrode 30*a* of the first input coupling electrode 40*a* toward an opposite side of the electrical signal input point 45*a*. The second output coupling conductor 41*b* is made into a rectangular that is 0.175 mm in width and 1.785 mm in length, and connected via the output side connection conductor 43*b* at a position of 0.11 mm from the center of the portion facing the first resonance electrode 30*b* of the first output coupling electrode 40*b* toward an opposite side of the electrical signal output point 45*b*. The input terminal electrode 60*a* and the output terminal electrode 60*b* are made into a square that are 0.2 mm on each side.

In the first resonance coupling conductor 71, the first preceding-stage side coupling region 71*a* and the first subsequent-stage side coupling region 71*b* are made into a rectangular that is 0.125 mm in width and 1 mm in length, and the first connection region 71*c* is made into a parallelogram that is 0.125 mm in width and 2.05 mm in length. In the second resonance coupling conductor 72, the second preceding-stage side coupling region 72*a* and the second subsequent-stage side coupling region 72*b* are made into a rectangular that is 0.125 mm in width and 0.2 mm in length, and the second connection region 72*c* is made into a parallelogram that is 0.125 mm in width and 3.3 mm in length. The shapes of the first ground electrode 21, the second ground electrode 22, the first annular ground electrode 23, and the second annular ground electrode 24 are made into a rectangular that is 3.8 mm in width and 5 mm in length, the opening of the first annular ground electrode 23 is made into a rectangular that is 3.3 mm in width and 3.65 mm in length, and the opening of the second annular ground electrode 24 is made into a rectangular that is 3.3 mm in width and 3.65 mm in length. The entire shape of the bandpass filter is made to be 3.8 mm in width, 5 mm in length, and 0.51 mm in thickness.

The interval between the top surface and the fifth interlayer is made to be 0.01 mm, the interval between the fifth interlayer and the second interlayer is made to be 0.12 mm, the interval between the second interlayer and the interlayer C is made to be 0.04 mm, the interval between the interlayer C and the interlayer D is made to be 0.065 mm, the interval between the interlayer D and the third interlayer is made to be 0.04 mm, the interval between the third interlayer and the first interlayer is made to be 0.015 mm, the interval between the first interlayer and the interlayer A is made to be 0.015 mm, the interval between the interlayer A and the fourth interlayer is made to be 0.02 mm, and the interval between the fourth interlayer and the bottom surface is made to be 0.085 mm. The thickness of each electrode is made to be 0.01 mm, and the diameter of the input side connection conductor 43*a*, the output side connection conductor 43*b*, and the through-conductor are made to be 0.1 mm. The relative permittivity of the dielectric layer 11 is made to be 7.5.

Figure 27:
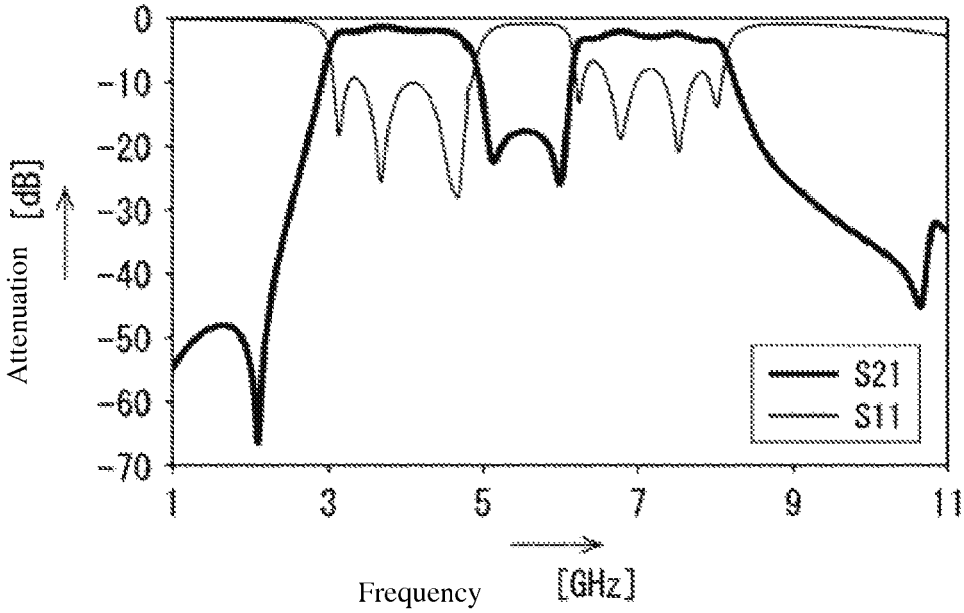
FIG. 27 is a diagram showing simulation results of electrical characteristics of the bandpass filter according to the Example 2.
Figure 28:
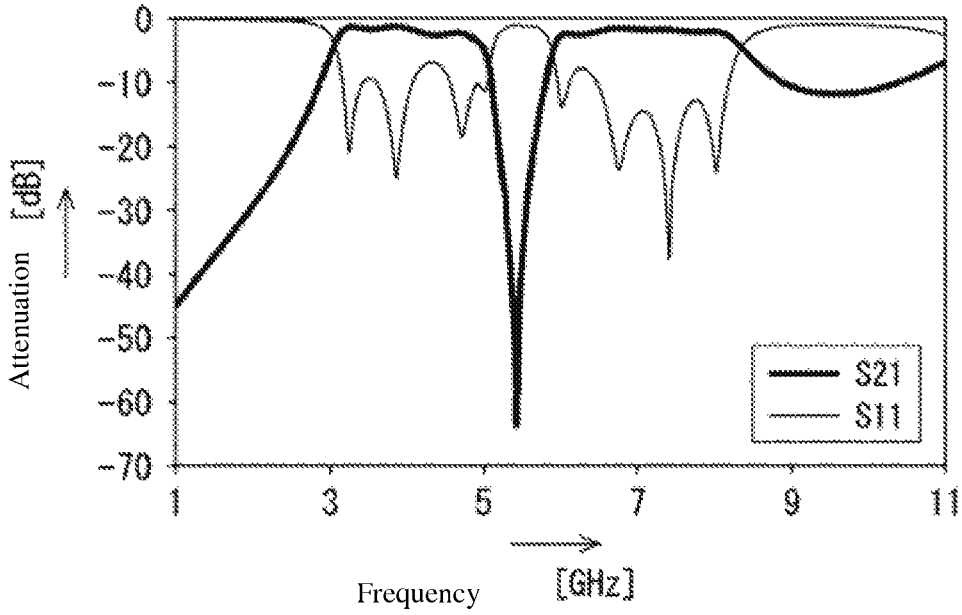
FIG. 28 is a diagram showing simulation results of electrical characteristics of the bandpass filter modified from the bandpass filter according to the Example 2.

FIG. 27 is a graph showing the simulation result, and FIG. 28 is a graph showing the simulation result of the bandpass filter comprising the structure in which the first resonance electrode coupling conductor 71 and the second resonance electrode coupling conductor 72 are removed from the bandpass filter of the sixth embodiment shown in FIG. 21 to FIG. 24. In each of the graphs, the horizontal axis indicates frequency and the vertical axis indicates attenuation, showing the bandpass characteristics (S21) and reflectance characteristics (S11) of the bandpass filter. According to the graphs shown in FIG. 27 and FIG. 28, although the thickness of the laminated body 10 is very think, being 0.51 mm, excellent bandpass characteristics that are flat and low-loss, in which impedance is well matched, can be obtained across the two substantially wide passbands. Additionally, it is verified, in the graph shown in FIG. 27, that attenuation poles are formed in the close vicinity of both sides of the respective two passbands, and that attenuation in the inhibition zone in the close vicinity of the passband is significantly improved if compared to the graph shown in FIG. 28. Based on this result, according to the bandpass filter of Example 2, even if it has a very thin shape, in of the respective two passbands, excellent bandpass characteristics, in which it is flat and low-loss across the entire wide passband, and excellent bandpass characteristics, in which attenuation from the passband to the inhibition zone is increased rapidly, and in which attenuation in the close vicinity of passband is sufficiently secured, can be obtained, and thereby the effectiveness of the present invention was verified.

The present invention may be implemented in a variety of other forms without deviating from the spirit and primary characteristics thereof. Therefore, the abovementioned embodiments are merely exemplifications in every aspects, and the scope of the present invention is not limited in any way by the specification, and should be defined only by the appended claims. Furthermore, all variations and modifications falling within the scope of the claims shall fall within the scope of the present invention.

DESCRIPTION OF THE SYMBOLS

10: Laminated body
11: Dielectric layer
21: First ground electrode
22: Second ground electrode
30*a*, 30*b*, 30*c*, 30*d*: First resonance electrodes
31*a*, 31*b*, 31*c*, 31*d*: Second resonance electrodes
40*a*: First input coupling electrode
40*b*: First output coupling electrode
41*a*: Second input coupling electrode
41*b*: Second output coupling electrode
43*a*: Input side connecting conductor
43*b*: Output side connecting conductor
45*a*: Electric signal input point
45*b*: Electric signal output point
71: First resonance electrode coupling conductor
71*a*: First preceding-stage side coupling region
71*b*: First subsequent-stage side coupling region
71*c*: First connection region
72: Second resonance electrode coupling conductor
72*a*: Second preceding-stage side coupling region
72*b*: Second subsequent-stage side coupling region
72*c*: Second connection region
80: Wireless communication module
81: Baseband portion
82: RF portion
84: Antenna
85: Wireless communication device

The invention claimed is:

1. A bandpass filter comprising:

a laminated body comprising a plurality of laminated dielectric layers;

a ground electrode disposed on a bottom surface of said laminated body;

a plurality of strip-shaped first resonance electrodes that are disposed side by side so as to be electromagnetically coupled to each other on a first interlayer of said laminated body, and each one end thereof is operable to be connected to a standard potential to function as a resonator that resonates at a first frequency;

a plurality of strip-shaped second resonance electrodes that are disposed side by side on a second interlayer different from said first interlayer of said laminated body so as to be electromagnetically coupled to each other, and each one end thereof is operable to be connected to the standard potential to function as a resonator that resonates at a second frequency which is higher than said first frequency;

a strip-shaped first input coupling electrode that is disposed on a third interlayer located between said first interlayer and said second interlayer of said laminated body, facing a first region over more than half the length, in the longitudinal direction, of a first resonance electrode on an input stage of said plurality of first resonance electrodes and electromagnetically coupled to the first region, and that has an electrical signal input point into which first electrical signals are input;

a strip-shaped first output coupling electrode that is disposed on said third interlayer of said laminated body, facing a second region over more than half the length, in the longitudinal direction, of a first resonance electrode on an output stage of said plurality of first resonance electrodes and electromagnetically coupled to the second region, and that has an electrical signal output point from which second electrical signals are output;

a second input coupling electrode that is disposed on said third interlayer of said laminated body, and that is facing a second resonance electrode on an input stage of said plurality of second resonance electrodes and electromagnetically coupled to the second resonance electrode on the input stage of said plurality of second resonance electrodes; and a second output coupling electrode that is disposed on said third interlayer of said laminated body, and that is facing a second resonance electrode on an output stage of said plurality of second resonance electrodes and electromagnetically coupled to the second resonance electrode on the output stage of said plurality of second resonance electrodes; and wherein:

said plurality of first resonance electrodes and said plurality of second resonance electrodes are disposed orthogonally to each other in a direction of lamination of said laminated body, a first portion of said first input coupling electrode faces the first resonance electrode on the input stage of said plurality of first resonance electrodes, said second input coupling electrode is connected to a side farther in the longitudinal direction from said electrical signal input point than the center of said first portion of said first input coupling electrode, said first electrical signals are input into the second input coupling electrode via said first input coupling electrode, a second portion of said first output coupling electrode faces the first resonance electrode on the output stage of said plurality of first resonance electrodes, said second output coupling electrode is connected to a side farther in the longitudinal direction from said electrical signal output point than the center of said second portion of said first output coupling electrode, and said second electrical signals are output from the second output coupling electrode via said first output coupling electrode.

2. The bandpass filter according to claim 1:

wherein there are four or more of said first resonance electrodes, and said first resonance electrodes are disposed side by side so as to alternate the one end and the other end on said first interlayer of said laminated body, and further comprising:

a first resonance electrode coupling conductor that is disposed on a fourth interlayer located on the opposite side of said third interlayer from said first interlayer, where one end is operable to be connected to the standard potential in the vicinity of said one end of said first resonance electrode on the input stage of said plurality of first resonance electrodes, the other end is operable to be connected to the standard potential in the vicinity of said one end of said first resonance electrode on the output stage of said plurality of first resonance electrodes, and has a strip-shaped first preceding-stage side coupling region that faces said one end of said first resonance electrode on the input stage to be electomagnetically coupled therewith, a strip-shaped first subsequent-stage side coupling region that faces said one end of said first resonance electrode on the output stage to be electomagnetically coupled therewith, and a first connecting region for connecting said first preceding-stage side coupling region and said first subsequent-stage side coupling region.

3. The bandpass filter according to claim 2, wherein said first preceding-stage coupling region faces said first resonance electrode on the input stage in parallel, said first subsequent-stage side coupling region faces said first resonance electrode on the output stage in parallel, and said first connection region is orthogonal to each of said first preceding-stage side coupling region and said first subsequent-stage side coupling region.

4. The bandpass filter according to claim 1:

wherein there are four or more of said plurality of second resonance electrodes, and said plurality of second resonance electrodes are disposed side by side so as to alternate the one end and the other end on said second interlayer of said laminated body, and further comprising:

a second resonance electrode coupling conductor that is disposed on a fifth interlayer located on the opposite side of said third interlayer from said second interlayer, where one end is operable to be connected to the standard potential in the vicinity of said one end of said second resonance electrode on an input stage of said plurality of second resonance electrodes, the other end is operable to be connected to the standard potential in the vicinity of said one end of said second resonance electrode on an output stage of said plurality of second resonance electrodes, and has a strip-shaped second preceding-stage side coupling region that faces said one end of said second resonance electrode on the input stage to be electromagnetically coupled therewith, a strip-shaped second subsequent-stage side coupling region that faces said one end of said second resonance electrode on the output stage to be electomagnetically coupled therewith, and a second connection region for connecting said second preceding-stage side coupling region and said second subsequent-stage side coupling region.

5. The bandpass filter according to claim 4, wherein said second preceding-stage side coupling region faces said second resonance electrode on the input stage in parallel, said second subsequent-stage side coupling region faces said second resonance electrode on the output stage in parallel, and said second connection region is orthogonal to each of said second preceding-stage side coupling region and said second subsequent-stage side coupling region.

6. The bandpass filter according to claim 1:

wherein there are four or more of said first resonance electrodes, and said plurality of first resonance electrodes are disposed side by side so as to alternate the one end and the other end on said first interlayer of said laminated body, and there are four or more of said plurality of second resonance electrodes, and said plurality of second resonance electrodes are disposed side by side so as to alternate the one end and the other end on said first interlayer of said laminated body, and further comprising:

a first resonance electrode coupling conductor that is disposed on a fourth interlayer located on the opposite side of said third interlayer from said first interlayer, where one end is operable to be connected to the standard potential in the vicinity of said one end of said first resonance electrode on the input stage of said plurality of first resonance electrodes, the other end is operable to be connected to the standard potential in the vicinity of said one end of said first resonance electrode on the output stage of said plurality of first resonance electrodes, and has a strip-shaped first preceding-stage side coupling region that faces said one end of said first resonance electrode on the input stage to be electromagnetically coupled therewith, a strip-shaped first subsequent-stage side coupling region that faces said one end of said first resonance electrode on the output stage to be electromagnetically coupled therewith, and a first connection region for connecting said first preceding-stage side coupling region and said first subsequent-stage side coupling region, and a second resonance electrode coupling conductor that is disposed on a fifth interlayer located on the opposite side of said third interlayer from said second interlayer, where one end is operable to be connected to the standard potential in the vicinity of said one end of said second resonance electrode on the input stage of said plurality of second resonance electrodes, the other end is operable to be connected to the standard potential in the vicinity of said one end of said second resonance electrode on, the output stage of said plurality of second resonance electrodes and has a strip-shaped second preceding-stage side coupling region that faces said one end of said second resonance electrode on the input stage to be electromagnetically coupled therewith, a strip-shaped second subsequent-stage side coupling region that faces said one end of said second resonance electrode on the output stage to be electromagnetically coupled therewith, and a second connection region for connecting said second preceding-stage side coupling region and said second subsequent-stage side coupling region.

7. The bandpass filter according to claim 6, wherein said first preceding-stage side coupling region faces said first resonance electrode on the input stage in parallel, said first subsequent-stage side coupling region faces said first resonance electrode on the output stage in parallel, and said first connection region is orthogonal to each of said first preceding-stage side coupling region and said first subsequent-stage side coupling region, and wherein said second preceding-stage side coupling region faces said second resonance electrode on the input stage in parallel, said second subsequent-stage side coupling region faces said second resonance electrode on the output stage in parallel, and said second connection region is orthogonal to each of said second preceding-stage side coupling region and said second subsequent-stage side coupling region.

8. The bandpass filter according to claim 1, wherein said second input coupling electrode is disposed so as to intersect said first resonance electrode on said one end side, in the longitudinal direction, of said first resonance electrode on the input stage if seen from the direction of lamination of said laminated body, and said second output coupling electrode is disposed so as to intersect said first resonance electrode on said one end side, in the longitudinal direction, of said first resonance electrode on the output stage in the direction of lamination of said laminated body.

9. The bandpass filter according to claim 1, wherein said second input coupling electrode is disposed on said third interlayer such that it is integrated with said first input coupling electrode, and said second output coupling electrode is disposed on said third interlayer such that it is integrated with said first output coupling electrode.

10. The bandpass filter according to claim 1, wherein said second input coupling electrode is disposed on a sixth interlayer located between said second interlayer and said third interlayer so as to be connected to said first input coupling electrode via an input side connecting conductor, and said second output coupling electrode is disposed on the sixth interlayer so as to be connected to said first output coupling electrode via an output side connecting conductor.

11. A wireless communication module comprising:

An RF portion including the bandpass filter according to claim 1; and a baseband portion connected to said RF portion.

12. A wireless communication device comprising an RF portion including the bandpass filter according to claim 1, a baseband portion connected to said RF portion, and an antenna connected to said RF portion.

* * * * *